US006541905B1

(12) United States Patent
Fushimi et al.

(10) Patent No.: US 6,541,905 B1
(45) Date of Patent: Apr. 1, 2003

(54) IMAGE FORMING APPARATUS

(75) Inventors: Masahiro Fushimi, Zama; Hideaki Mitsutake, Yokohama; Hidetoshi Suzuki, Fujisawa, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/628,700

(22) Filed: Jul. 28, 2000

Related U.S. Application Data

(62) Division of application No. 09/294,332, filed on Apr. 20, 1999, now Pat. No. 6,124,671, which is a division of application No. 08/631,891, filed on Apr. 16, 1996, now Pat. No. 5,936,343.

(30) Foreign Application Priority Data

Apr. 21, 1995 (JP) ..... 7-096963
Apr. 10, 1996 (JP) ..... 8-088268

(51) Int. Cl.[7] ..... H01J 19/42

(52) U.S. Cl. ..... 313/495; 313/497; 313/309; 313/336; 313/351; 313/306

(58) Field of Search ..... 313/495, 496, 313/497, 309, 336, 351, 306

(56) References Cited

U.S. PATENT DOCUMENTS

| | | | | |
|---|---|---|---|---|
| 4,855,636 | A | 8/1989 | Busta et al. | 313/336 |
| 4,904,895 | A | 2/1990 | Tsukamoto et al. | 313/336 |
| 5,066,883 | A | 11/1991 | Yoshioka et al. | 313/309 |
| 5,448,131 | A | 9/1995 | Taylor et al. | 313/292 |
| 5,530,314 | A | 6/1996 | Banno et al. | 313/336 |

(List continued on next page.)

FOREIGN PATENT DOCUMENTS

| | | |
|---|---|---|
| EP | 0 496 450 | 7/1992 |
| EP | 0 405 262 | 6/1994 |
| EP | 0 631 295 | 12/1994 |
| EP | 0 660 358 | 6/1995 |
| JP | 57-118355 | 7/1982 |

(List continued on next page.)

OTHER PUBLICATIONS

M.I. Elinson, et al., "The Emission of Hot Electrons and the Field Mission of Electrons from Tin Oxide", Radio Engineering and Electronic Physics, pp. 1290–1296 (Jul. 1965).

(List continued on next page.)

*Primary Examiner*—Ashok Patel
(74) *Attorney, Agent, or Firm*—Fitzpatrick, Cella, Harper & Scinto

(57) ABSTRACT

An image forming apparatus includes a first substrate and a second substrate disposed opposite to the first substrate, with fluorescent material being provided on the second substrate. A matrix wiring having a plurality of first wires and a plurality of second wires is provided, with each of the first wires located on the first substrate, and each of the second wires intersecting the plurality of first wires. Also included are electron-emitting devices, each of which emit an electron by applying a signal to the matrix wiring, and a metal electrode, having a plate-shaped form, provided above the matrix wiring, with the metal electrode having electron through-holes for passing electrons emitted by the electron-emitting devices. A support member, having a plate-shaped form, is provided on the metal electrode, wherein the metal electrode is arranged in parallel to the first substrate and a longitudinal direction of a cross section of the support member and a longitudinal direction of a cross-section of the metal electrode are perpendicular and intersect both of the metal electrode and the support member.

9 Claims, 21 Drawing Sheets

U.S. PATENT DOCUMENTS

| | | | | | |
|---|---|---|---|---|---|
| 5,532,548 | A | * | 7/1996 | Spindt et al. | 313/495 X |
| 5,569,974 | A | | 10/1996 | Morikawa et al. | 313/310 |
| 5,589,731 | A | | 12/1996 | Fahlen et al. | 313/495 |
| 5,594,296 | A | | 1/1997 | Mitsutake et al. | 313/309 |
| 5,614,781 | A | | 3/1997 | Spindt et al. | 313/495 |
| 5,659,329 | A | | 8/1997 | Yamanobe et al. | 313/309 |
| 5,682,085 | A | | 10/1997 | Suzuki et al. | 315/169.1 |
| 5,729,086 | A | | 3/1998 | Jeong et al. | 313/495 |
| 5,742,117 | A | * | 4/1998 | Spindt et al. | 313/495 X |
| 5,760,538 | A | | 6/1998 | Mitsutake et al. | 313/422 |
| 5,789,857 | A | | 8/1998 | Yamaura et al. | 313/292 X |
| 5,821,689 | A | | 10/1998 | Andoh et al. | 313/495 |
| 5,828,352 | A | | 10/1998 | Nomura et al. | 345/74 |
| 5,844,360 | A | * | 12/1998 | Jeong et al. | 313/495 |
| 5,936,343 | A | * | 8/1999 | Fushimi et al. | 313/336 X |
| 5,955,850 | A | * | 9/1999 | Yamaguchi et al. | 313/336 X |
| 6,157,137 | A | | 12/2000 | Suzuki et al. | 315/169.1 |

FOREIGN PATENT DOCUMENTS

| | | | |
|---|---|---|---|
| JP | 64-31332 | | 2/1989 |
| JP | 2-257551 | | 10/1990 |
| JP | 2-299137 | | 12/1990 |
| JP | 3-55738 | | 3/1991 |
| JP | 3-149736 | | 6/1991 |
| JP | 4-28137 | | 1/1992 |
| JP | 5-249914 | | 9/1993 |
| JP | 5-266807 | * | 10/1993 |
| JP | 7-282718 | | 10/1995 |
| JP | 8-185816 | | 7/1996 |
| JP | 8-250050 | * | 9/1996 |
| WO | WO 94/18694 | | 8/1994 |
| WO | WO 94/20975 | | 9/1994 |

OTHER PUBLICATIONS

G. Dittmer, "Electrical Conduction and Electron Emission of Discontinuous Thin Films", Thin Solid Films, 9, pp. 317–328 (1982).

M. Hartwell, et al., "Strong Electron Emission from Patterned Tin–Indium Oxide Thin Films", International Electron Devices Meeting, pp. 519–521 (1975).

H. Araki, et al., "Electroforming and Electron Emission of Carbon Thin Films", Journal of the Vacuum Society of Japan, vol. 26, No. 1, pp. 22–29 (Sep. 24, 1981).

W.P. Dyke, et al. "Field Emission", Advances in Electronics and Electron Physics, vol. VIII, pp. 89–185 (1956).

C.S. Spindt, et al., "Physical Properties of Thin–Film Field Emission Cathodes with Molybdenum Cones", Journal of Applied Physics, vol. 47, No. 12, pp. 5248–5263 (Dec. 1976).

C.A. Mead, Operation of Tunnel–Emission Devices, Journal of Applied Physics, vol. 32, No. 4, pp. 646–652 (Apr. 1961).

R. Meyer, et al., "Recent Development on "Microtips" Display at LETI", Technical Digest of 4$^{th}$ International Vacuum Microelectronic Conference, Nagahama, pp. 6–9 (1991).

* cited by examiner (DELETED OR CUT ALONG A-A')

(DELETED OR CUT ALONG B-B')

IMAGE FORMING APPARATUS

This application is a divisional of application Ser. No. 09/294,332, filed Apr. 20, 1999 now U.S. Pat. No. 6,124, 671, which is a divisional of application Ser. No. 08/631, 891, filed Apr. 16, 1996 now U.S. Pat. No. 5,936,343.

BACKGROUND OF THE INVENTION

1. Field of Invention

This invention relates to an image forming apparatus utilizing electron-emitting devices and, more particularly to an image forming apparatus in which a spacer as a support member is provided within the apparatus.

2. Description of Related Art

Conventionally, two types of electron-beam emitting devices, namely thermionic cathode electron-beam emitting devices and cold cathode electron-beam devices are known. Examples of cold cathode electron-emitting devices are electron-emitting devices of surface-conduction emission (hereinafter abbreviated to "SCE") type, field emission (hereinafter abbreviated to "FE") type, and metal/insulator/metal (hereinafter abbreviated to "MIM") type.

A known example of the SCE type electron-emitting devices is described in "Radio Eng. Electron Phys., 10, 1290" (1965) by M. I. Elinson, and other examples will be described later.

The SCE type electron-emitting device utilizes a phenomenon where electron-emission is produced in a small-area thin film formed on a substrate, by passing a current parallel to the film surface. As the SCE type electron-emitting devices, electron-emitting devices using an $SnO_2$ thin film by Elinson mentioned above, an Au thin film by G. Dittmer ("Thin solid Films", 9,317 (1972)), an $In_2O_3/SnO_2$ thin film by M. Hartwell and C. G. Fonstad ("IEEE Trans. ED Conf.", 519 (1975)), a carbon thin film by Hisashi Araki et al. ("Vacuum", vol. 26, No. 1, p. 22 (1983)) are reported.

FIG. 5 is a plan view of the SCE type electron-emitting device by M. Hartwell and C. G. Fonstad described above, as a typical example of the structure of the SCE type electron-emitting devices. In FIG. 5, reference numeral 501 denotes a substrate; 502, a conductive thin film of a metal oxide formed by sputtering, having a H-shaped pattern. An electron-emitting portion 503 is formed by electrification process referred to as "energization forming" to be described later, on the conductive thin film 502. In FIG. 5, the interval L is set to 0.1–1 mm, and the width W is set to 0.1 mm. Note that the electron-emitting portion 503 is shown at approximately the center of the conductive thin film 502, with a rectangular shape, for convenience of illustration, however, this does not exactly show the position and shape of the actual electron-emitting portion 503.

In these conventional SCE type electron-emitting devices by M. Hartwell and the others, the electron emission portion 503 is typically formed by performing electrification, "energization-forming", on the conductive thin film 502. According to the energization forming process, electrification is made by applying a direct current where voltage increases at a very slow rate of, e.g., 1 V/min., to both ends of the conductive thin film 502, so as to partially destroy or deform the conductive thin film 502, thus form the electron-emitting portion 503 with electrically high resistance. Note that the destroyed or deformed part of the conductive thin film 502 have a fissure. Upon application of appropriate voltage to the conductive thin film 502 after the energization forming, electron emission is made near the fissures.

Examples of the FE type electron-emitting devices are given in, e.g., W. P. Dyke & W. W. Dolan, "Field Emission", Advance in Electron Physics, 8,89 (1956) and C. A. Spindt, "Physical Properties of Thin-Film Field Emission Cathodes With Molybdenium Cones", J. Appl. Phys., 47,5248 (1976).

FIG. 6 is a cross-sectional view of the FE type electron-emitting device according to C. A. spindt and the others mentioned above, as a typical example of the structure of the FE type electron-emitting devices. In FIG. 6, numeral 601 denotes a substrate; 602, an emitter wiring electrode; 605, an emitter corn; 603, an insulating layer; and 604, a gate electrode. In this device, electron emission is made by applying an appropriate voltage between the emitter corn 605 and the gate electrode 604.

Further, as-another example of the FE type electron-emitting devices, a structure where the emitter and the gate electrode are provided approximately parallel to the substrate surface is known.

Further, examples of the MIM type electron-emitting devices are described in, e.g., C. A. Mead, "Operation of Tunnel-Emission Devices", J. Apply. Phys., 32, 646 (1961), and other references. FIG. 7 is a cross-sectional view showing a typical structure of the MIM type electron-emitting device. In FIG. 7, numeral 701 denotes a substrate; 702, a lower electrode comprising a metal member; 703, a thin insulating layer having a thickness of about 100 Å; and 704, an upper electrode comprising a metal member having a thickness of 80 to 300 Å. In the MIM type electron-emitting device, electron emission is caused from the surface of the upper electrode 704 by applying an appropriate voltage between the upper and lower electrodes 703 and 702.

In comparison with the thermionic cathode electron-beam emitting devices, the cold cathode electron-emitting devices can obtain electron emission at a lower temperature and, therefore do not need a heater. Accordingly, the cold cathode electron-emitting devices has a structure simpler than that of the thermionic cathode electron-emitting devices, which enables more compact electron-emitting devices. In addition, even if a multitude of electron-emitting devices are arranged on a substrate in high density, heat-melting of the substrate does not easily occur. Further, different from the thermionic cathode electron-emitting devices that have slow response because they operate after being heated, the cold cathode electron-emitting devices have quick response.

For these reasons, the applications of the cold cathode electron-emitting devices have been positively studied.

For example, the SCE type electron-emitting devices have the simplest structure and therefore can be easily manufactured, they are advantageous for forming a large number of electron-emitting devices on a large area. As disclosed in Japanese Patent Application Laid-Open No. 64-31332, many methods for arranging the SCE type electron-emitting devices and driving them have been studied.

Also, applications of the SCE type electron-emitting devices to, e.g., image forming apparatuses such as an image display device and an image recording device, electrical charge beam source and the like have been proposed.

Especially, as applications to image display apparatuses, as shown in the U.S. Pat. No. 5,066,833 by the present applicant, Japanese Patent Applications Laid-Open Nos. 2-257551 and 4-28137, an image display apparatus using the combination of SCE type electron-emitting devices and a fluorescent material which emits light upon reception of an electronic beam has been studied. This type of image display apparatus is expected to have excellent characteristics better than other conventional image display apparatuses. For example, in comparison with recently focused liquid crystal display apparatuses, the above display apparatus is superior in that it does not require a backlight since it is a self light-emitting type and that it has a wide view angle.

Methods for arranging a large number of FE type electron-emitting devices and driving the devices are disclosed in, e.g., the U.S. Pat. No. 4,904,895 by the present applicant. As an application of the FE type electron-emitting devices to an image display apparatus, a flat-type display device is reported by R. Meyer and others ("Recent Development on Microtips Display at LETI", Tech. Digest of 4th Int. Vacuum Microelectronics Conf., Nagahama, pp. 6–9 (1991)).

An application of the MIM type electron-emitting devices as an image display device, where a large number of MIM type electron-emitting devices are arranged, is disclosed in Japanese Patent Application Laid-Open No. 3-55738 by the present applicant.

Accordingly, a multi electron-beam source having cold cathode electron-emitting devices wired in a simple matrix has possibilities in a variety of applications. For example, an electron-beam source for an image display device can be provided by appropriately applying an electric signal based on image information to the multi electron-beam source.

Recently, in the field of display devices utilizing cathode luminescence, thin type display devices are desired, and various efforts have been made to reduce the thickness of display devices. For example, as described above, a flat type CRT having a flat-type container where electron-emitting devices are arranged on the rear plate and fluorescent material is arranged on the face plate has been considered. In this flat-type CRT, the weight has been a serious problem.

The flat-type CRT must have an airtight container that maintains a vacuum condition so that electrons emitted from the electron-emitting devices can reach the fluorescent material without colliding with gas molecules in the atmosphere. This prevents the reduction of the weight of the container. Generally, it is preferable to maintain the pressure within the CRT at $10^{-6}$ torr or less. Since the airtight container must have strength against approximately 1 atm to maintain this inner pressure, it needs thick constituent parts (e.g., face plate, rear plate and side walls), thus the weight of the container is great.

To solve this problem, a structure having support members for supporting atmospheric pressure between the face plate and rear plate has been proposed. This structure obtains sufficient strength even if the thickness of the outer walls (face plate, rear plate and side walls) is thinned.

Thus, the weight of the flat-type CRT can be reduced by providing the support members, however, still there are problems such as the following:

<Problem 1>

The quality of display image is degraded due to electrical charge on the support members.

In the airtight container, there exist many electrically-charged particles, such as ions occurred upon collision of electrons with the fluorescent material, or residual gas particles as well as electrons emitted from the electron-emitting devices. The electrical charge up may occur if these electrically-charged particles continuously collide with the support members.

The electrical charge on the support member changes the electric potential distribution, which disturbs the control of electron beams. For example, the cut-off voltage of the electron beam is drifted, or the electron beam is deflected to traverse an unexpected trajectory. As a result, the degradation of image quality such as disabled luminance control of display images or deformation of image occur.

<Problem 2>

Spark discharge occurs along the surface of the support members. The spark discharge passes a great amount of current through the parts in an instant and damages the fluorescent material and electrodes.

Display devices in which solution of these problems are attempted have been reported.

An example of the display device for solving the first problem is disclosed in Japanese Patent Laid-Open No. 57-118355. FIG. 21 shows the cross-section of the display device, in which numeral 2125 denotes a face plate; 2108, a rear plate; 2123, a fluorescent material; 2113, thermionic cathodes; 2112, support members comprising conductive material, for supporting the thermionic cathodes 2113; 2122, a metal back for applying a voltage to the fluorescent material 2123; 2116 and 2118, electrodes comprising of metal material, for on/off control of electrons emitted from the thermionic cathodes 2113; 2120, electrodes comprising of metal material, for accelerating the electrons; and 2115, 2117, 2119 and 2121, support members comprising of insulating material. The structure, in which electrodes and support members are alternatively layered, supports atmospheric pressure upon the face plate 2125 and the rear plate 2108.

If the support members 2115, 2117 and 2119 are electrically charged, the cut-off voltage of the electron beams drifts to disturb the luminance control of display images. For this reason, the support members are covered with a conductive film. If the support member 2121 is electrically charged, the trajectories of the electron beams are deflected to deform a display image. For this reason, the support member 2121 is also covered with a conductive film.

In this display device, even if charged particles collide with the support members, the electrical charge can be moved through the conductive films to the electrodes and thermionic cathode electrodes, thus electrical charge on the support members can be prevented. As a result, the drift of the cut-off voltage of the electron beams and the deflection of the beam trajectories can be reduced.

A display device in which solution of the second problem is attempted is disclosed in EP 0405262B1.

FIG. 8 shows the cross-section of this display device, in which numeral 801 denotes a face plate; 811, a rear plate; 809, cathodes (FE type electron-emitting devices); 805, fluorescent material; and 803, an anode electrode for accelerating the electrons. The symbol S denotes support members for supporting atmospheric pressure upon the face plate 801 and the rear plate 811. Numeral 813 denotes a side wall of an airtight (vacuum) container.

In this structure, one end of the support member S is in contact with the cathode 809, while the other end of the support member S is in contact with the anode electrode 803, thus the both ends of the support member S receive a high voltage. If the support member S comprises insulating material, spark discharge occurs. However, the spark discharge can be prevented by forming the support member S with conductive material.

Accordingly, this structure can prevent the fluorescent material 805, the anode electrode 803 or the other parts from being damaged by spark discharge.

The above two display devices both provide conductivity to support members. However, the conductivity of the support members electrically connects parts arranged between the support members. To avoid electrical charge up and spark discharge, irregularly-drifting current flows through the support members. In other words, the support members become resources of electric noise. These factors cause the following problems:

<Problem 3>

The modulation of output intensity of electron beams is disturbed. The electrical connection between the support members and the parts in contact with the support members is the main factor of the following troubles:

a. Irregularly-drifting noise intruded into a modulation circuit causes erroneous operation of the circuit. In the worst case, the noise damages the modulation circuit.
b. A modulation signal is leaked to other parts via the support members, causing degradation of image quality such as cross-talk in display images.
c. The load on the modulation circuit increases. In case of a conventional modulation circuit, driving power becomes insufficient due to this increased load, thus lowering the response speed.

For example, in the device shown in FIG. 21, the modulation of electron beams is performed between the electrodes 2116 and 2118. In this structure, irregularly-drifting noise intrudes into a modulation circuit (not shown) connected to these electrodes. Further, the modulation signals applied to the electrodes 2116 and 2118 are leaked to the opposite electrode or to the other parts (e.g., the electrodes 2120 and the thermionic cathodes 2113). Furthermore, the conductivity given to the support members 2115, 2117 and 2119 increases resistive load upon the modulation circuit.

In the device shown in FIG. 8, the modulation of electron beams is performed by applying modulation signals to the cathodes 809. In this structure, irregularly-drifting noise intrudes from the support member S into a modulation circuit (not shown) connected to the cathodes 809. Further, the modulation signal applied to each cathode is leaked to another cathode via the support member S. Furthermore, the conductivity given to the support members S increases resistance load upon the modulation circuit.

<Problem 4>

The operation of the electron-emitting device becomes unstable otherwise the life of the device becomes short. That is, the electrical connection between the support members or parts in contact with the support members causes the following inconveniences e. Application of irregularly-drifting noise makes the operation of the electron-emitting device unstable. This varies the intensity of emitted electron beams. Further, in comparison with a case where noise does not intrude into the device, the life of the device becomes shorter.
f. Signals applied to other parts are leaked to the electron-emitting device via the support members, and affect electron-beam output to drift. This results in change of the luminance of display images.

For example, in the device shown in FIG. 21, the thermionic cathodes 2113 receive irregular noise from the support members 2115. Further, the signals applied to the electrodes 2116 are leaked to the thermionic cathodes 2113 via the support members.

In the device shown in FIG. 8, the cathodes 809 receive irregular noise from the support members S. Further, if the voltage applied to the anode electrode 803 drifts, the potential of the electron-emitting device is varied due to the drifted voltage.

SUMMARY OF THE INVENTION

The present invention has its object to provide an image forming apparatus that solves all the above problems. That is to provide a flat-type image forming apparatus, with support members for the purpose of downsizing of the apparatus, which produces display images without degradation of image quality, and has stable operation, and has a long life.

According to the present invention, the foregoing object is attained by providing an image forming apparatus having: a substrate; an electron-emitting device; a wiring electrode, provided on the substrate, for applying a driving signal to the electron-emitting device; an image forming member to which an electron emitted from the electron-emitting device is irradiated; and an acceleration electrode provided opposing to the substrate, the apparatus comprising:

potential-defining means provided between the acceleration electrode and the substrate;

second support member connected to the potential-defining electrode and the acceleration electrode; and first support member connected to the wiring electrode and potential-defining means, wherein the second support member has a semiconductive material surface, and wherein the first support member has resistance greater than that of the second support member by ten times or more, further wherein predetermined potential is applied to the potential-defining means.

Preferably, in the image forming apparatus, the second support member has surface resistivity of $10^5$ [Ω/□] or greater to $10^{13}$ [Ω/□] or less.

In the image forming apparatus, an electron-beam source is constituted with the electron-emitting device, connected with m scan-signal wiring electrodes and n information-signal wiring electrodes, layered via an insulating layer therebetween, on the substrate; and the first support member is provided on at least one of the m scan-signal wiring electrodes and n information-signal wiring electrodes; further, the potential-defining means is provided on the first support member.

In the image forming apparatus, the potential-defining means respectively focuses electron beam emitted from the electron-emitting device.

In the image forming apparatus a voltage Vc applied to the potential-defining means satisfies the relations:

$0.2 \times Q \leqq Vc \leqq Q$ $Q=(Va-Vf)\times(h+Tc/2)/H$

Vc: a voltage applied to the potential-defining means [V]

Vf: a voltage applied to the electron-emitting device [V]

Va: a voltage applied to the acceleration electrode [V]

Tc: a thickness of the potential-defining means [mm]

H: a distance between the electron-emitting device and the acceleration electrode [mm]

h: a distance between the electron-emitting device and the potential-defining means [mm]are satisfied.

In the image forming apparatus, the electron-emitting device is a cold cathode electron-emitting device.

In the image forming apparatus, the electron-emitting device is a surface-conduction emission type electron-emitting device.

In the image forming apparatus, the electron-emitting device is a flat field emission type electron-emitting device.

In the image forming apparatus, the potential-defining means is an ion blocking member which covers above the electron-emitting region of the electron-emitting device.

In the image forming apparatus, the second support members is a plate.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

[General Embodiment]

First, a general embodiment of the present invention will be described in detail with reference to FIG. 1.

Figure 1:
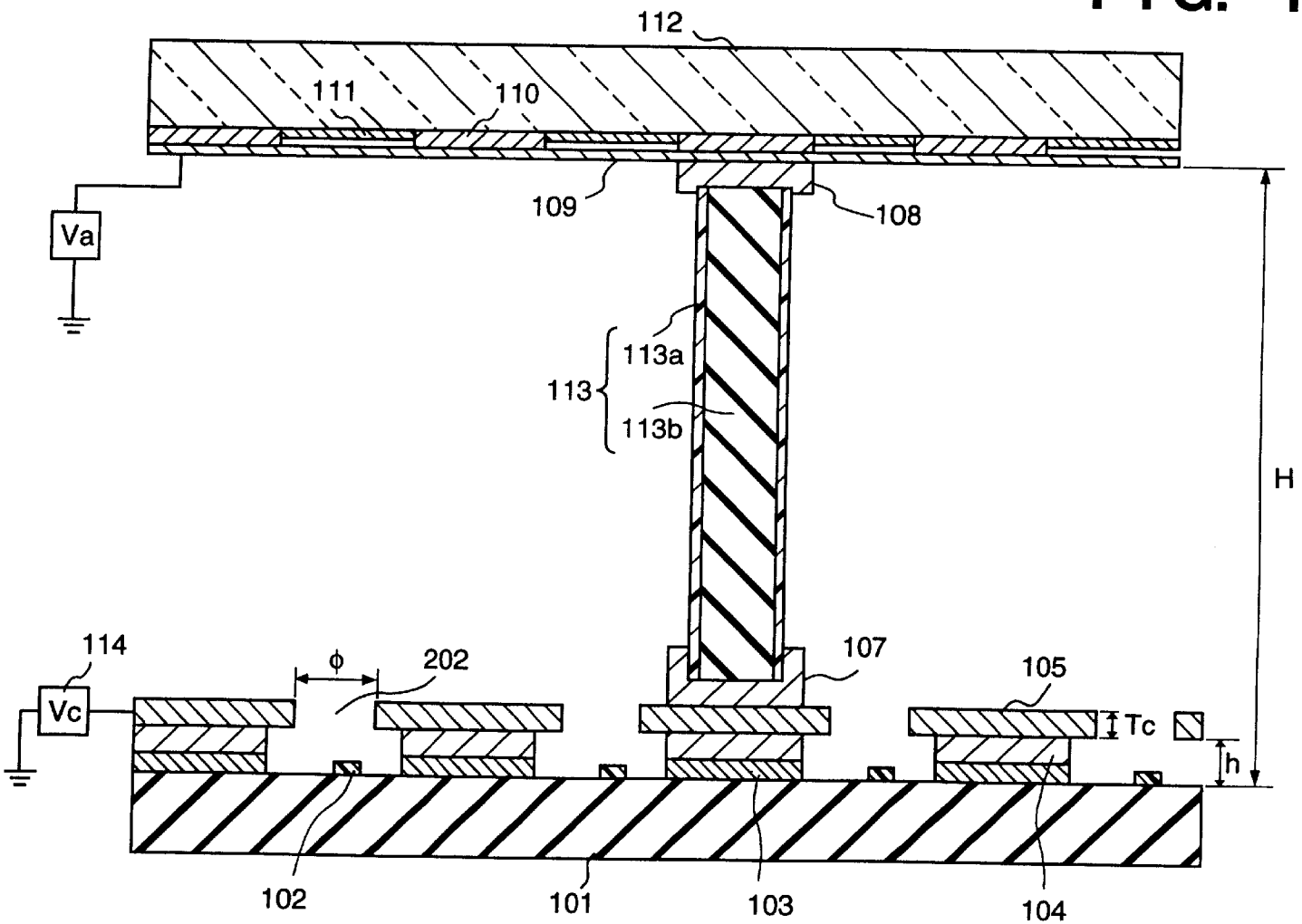
FIG. 1 is a cross-sectional view showing an example of an image forming apparatus of the present invention.

FIG. 1 is a cross-sectional view showing an image forming apparatus of the present invention.

In FIG. 1, the image forming apparatus comprises a rear plate (substrate) 101 on which a plurality of electron-emitting devices 102 are formed, a face plate 112 on which fluorescent members 111 are formed, potential-defining electrode 105 provided between the face plate 112 and the rear plate 101, first support members 104 provided between the rear plate 101 and the potential-defining electrode 105, and second support members 113 provided between the potential-defining electrode 105 and the face plate 112. The first support members 104, the potential-defining electrode 105 and the second support members 113 are in corporation with each other to support atmospheric pressure upon the rear plate 101 and the face plate 112.

The plurality of electron-emitting devices 102 are electrically connected to the row-direction wiring electrodes 103 and column-direction wiring electrodes (not shown).

The potential-defining electrode 105 is connected to a power source 114 having a constant voltage.

Assuming that an electric resistance of the first support members 104 is R1 (Ω) and that of the second support member 113 is R2 (Ω), the resistance RI is greater than the resistance R2 by ten times or more, or more preferably, hundred times or more.

The present inventors have found that extreme electrical charge up and spark discharge in the support members mainly occur around a portion of the support member close to the face plate. It is considered that this relates to secondary electrons or ions emitted from the fluorescent material upon irradiation of the fluorescent material with electrons from the electron-emitting devices. According to the inventors, the electrical charge up and spark discharge can be effectively prevented by reducing the electric resistance R2 of the second support members 113 provided on the face plate side to a sufficiently low level.

Further, in consideration of the fact that irregular noise occurs from the second support members 113, the potential-defining electrode 105 where a constant voltage has been applied are provided under the second support members 113. Drive signals for modulating electron beams are applied to the electron-emitting devices 102 via the row- and column-direction wiring electrodes. The first support members 104 having a fully large electric resistance are provided between the wiring electrodes and the potential-defining electrodes 105, so that the noise occurs at the second support members 113 and is absorbed into the potential-defining electrode 105 having a constant voltage. Further, the high-resistant first support members 104 serve as effective insulating member.

Accordingly, this structure effectively protects the modulation circuit from the irregular noise occurring from the second support members 113, thus preventing the modulation circuit from erroneously operating or being damaged by the intrusion of noise. Further, the load on the modulation circuit does not increase.

In addition, the structure effectively protects the electron-emitting devices from the irregular noise occurred from the second support members 113, thus preventing inconveniences where the operation of the electron-emitting devices become unstable, and that their lives are shortened.

Further, as the first support members 104 have a large resistance value, a modulation signal applied to an electron-emitting device is not leaked to another electron-emitting device to cause cross-talk.

In the general embodiment of the present invention, the first support members 104 is comprised of insulating material. The second support members 113 have bases 113*b* comprised of insulating material, and conductive films 113*a*, having a surface resistivity of $10^5$ [Ω/sq] or greater to $10^{13}$ [Ω/sq] or less, more preferably, $10^8$ [Ω/sq] or greater to $10^{10}$ [Ω/sq] or less, covering the conductive films 113*a*. This structure saves almost all electricity at the first support members 104, and reduces electric consumption at the second support members 113 within a range preventing electrical charge or spark discharge, as well as the advantageous points as described above.

Further, in the general embodiment, when it is assumed that the voltage to be applied to the potential-defining electrode 105 is Vc [volt], the following expressions are held:

$0.2\times Q \leqq Vc \leqq Q$ $Q=(Va-Vf)\times(h+Tc/2)/H$

H: Interval between electron-emitting devices and acceleration electrode [mm]

h: Height of first support members [mm]

Tc: Thickness of potential-defining electrodes [mm]

Va: Voltage applied to fluorescent material [volt]

Vf: Maximum value of drive voltage applied to electron-emitting devices [volt]

If these relations are satisfied, efficiency of use of electrons emitted from the electron-emitting devices can be maintained within a practical range, and focusing of each electron-beam can be attained as well as the above advantageous points.

Further, the rectangular-prism shape of the second support members 113 can render the slope of the potential on the second support members 113 even. Accordingly, the electrooptical influence by providing the second support members 113 can be minimized, and the electron-beam trajectories at the second support members 113 and those at positions where the second support members 113 are not provided can correspond to each other. Thus, the rectangular-prism shape of the second support members 113 is advantageous in the present invention.

Next, the preferred embodiments of the present invention will be described below.

[First Embodiment]

A first embodiment will be described in accordance with FIGS. 1–2, 9–11 and 13–19.

First, the basic structure of a display panel of a display apparatus will be described with reference to FIGS. 1 and 2. The structure and manufacturing method of the support members and potential-defining electrodes will be described in detail.

Figure 13:
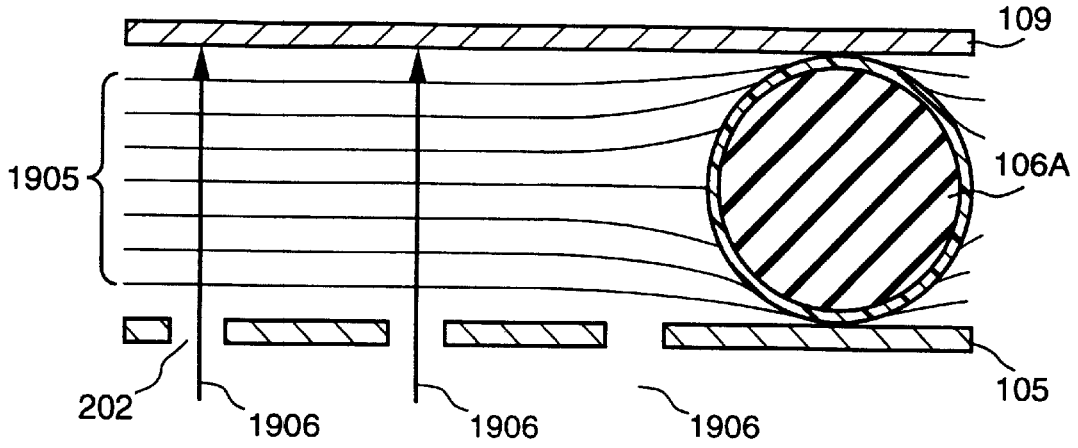
FIGS. 13 and 14 are cross-sectional views explaining an advantage of the present invention by virtue of the difference of the shape of the conductive support members.

Then, a desirable shape of the second support members will be described with reference to FIGS. 13 and 14.

Next, the structure, manufacturing method and characteristic of the electron-emitting devices will be described with reference to FIGS. 9, 10 and 19.

Next, the construction and driving method of a multi electron-beam source having a matrix-wired electron-emitting devices will be described with reference to FIGS. 11, 16 to 18.

Finally, the construction of the display device circuit will be described with reference to FIG. 15.

First, the most characteristic feature of the present embodiment will be described using FIGS. 1 and 2. FIG. 1 shows the cross-section of the image display device, and FIG. 2, a part of the potential-defining electrode.

Figure 2:
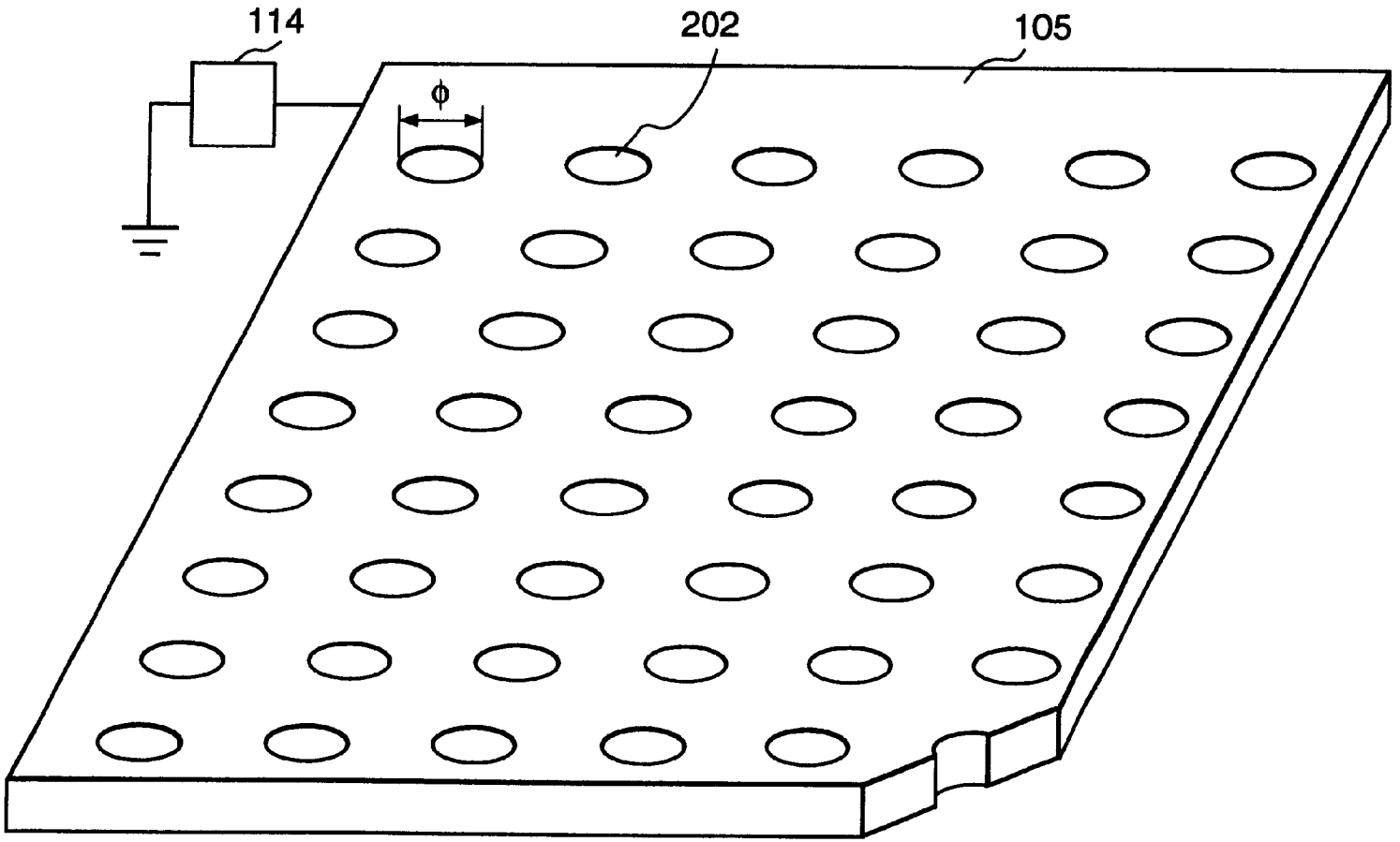
FIG. 2 is a perspective view showing a potential defining electrode of the image forming apparatus in FIG. 1.

In FIGS. 1 and 2, reference numeral 101 denotes the substrate plate; 102, the electron-emitting devices; 103, the row-direction wiring electrodes for supplying drive signals to the electron-emitting devices 102; 104, insulating members, covered with the conductive film 113*a*, which function as the first support members; 105, the potential-defining electrode; 113, spacers which function as the second support members; 107, a conductive connection member for connecting the spacer with the potential-defining electrode; 108, a conductive connection member for connecting the spacer with an acceleration electrode; 109, the acceleration electrode; 110, black stripes. (black conductive material); 111, the fluorescent member; 112, the face plate; and 202, electron through holes.

The conductive connection member 108 electrically connects a conductive film 113*a* formed on the surface of the spacer 113 with the acceleration electrodes 109, and the conductive connection member 107 electrically connects the conductive film 113*a* with the potential-defining electrode 105. The potential-defining electrode 105 are electrically connected with the external power source 114.

As the electron-emitting devices 102 emit electrons and an acceleration voltage Va is applied to the acceleration electrode 109, the electrons are drawn upward to collide with the fluorescent member 111, thus cause the fluorescent member 111 to emit light. At this time, application of a constant voltage to the external power source 114 passes weak current through the conductive film 113*a* on the surface of the spacer 113.

Preferably, the potential-defining electrode 105 is stable in the vacuum condition and comparatively stable against irradiation with electrons, and has a low electric resistance. As material of the potential-defining electrode 105, metals such as copper and nickel, alloys and the like are desirable. Further, insulating members coated with conductive material can be employed.

As shown in FIG. 2, the potential-defining electrode 105 according to the first embodiment is a metal plate electrode in which electron through holes 202 are formed.

The shape and size of the electron through holes 202 may be selected in accordance with the image forming apparatus. For example, the electron through holes 202 may be oval-shaped or polygon-shaped as well as round shape.

The voltage of the external power source 114 may be selected in accordance with the image forming apparatus. Further, the size of electron beams and the positions of beam-spots can be adjusted in accordance with selected voltage.

The spacers 113 can merely have insulation to resist a high voltage applied between the potential-defining electrode 105 and the acceleration electrode 109. For this reason, the surface of the insulating substrate 113*b* is covered with the conductive film 113*a* having high-resistance.

As the insulating substrate 113*b*, glass such as quartz glass, and soda-lime glass where impurities are reduced, and ceramic materials such as alumina may be employed. Preferably, the material of the insulating substrate 113*b* has a thermal-expansion coefficient close to that of the material of the insulating substrate 101.

As for the conductive film 113*a*, for maintaining prevention of electrical charge up and spark discharge and for suppressing electric consumption due to current leakage, its surface resistivity is preferably $10^5$ [Ω/□] or greater.

Further, the inventors found that it is preferable that the surface resistivity of the conductive films 113*a* is $10^{13}$ [Ω/□] or less, and more preferably, $10^8$ to $10^{10}$ [Ω/□].

The material of the conductive films 113*a* may be metals such as Pt, Au, Ag, Rh and Ir, metal films, including island-state particle groups, comprising of alloys from Al, Sb, Sn, Pb, Ga, Zn, In, Cd, Cu, Ni, Co, Rh, Fe, Mn, Cr, V, Ti, Zr, Nb, Mo and W, and conductive oxide such as NiO, $SnO_2$ and ZnO.

The conductive film 113*a* can be formed by vacuum film forming methods such as vacuum-evaporation, sputtering and chemical vapor deposition, application methods comprised of applying an organic solvent or a diffused solvent to the substrate by dipping or by using a spinner then sintering the applied paste, and non-electrolyte plating of forming a metal film on the surface of insulating material with metallic compound by utilizing chemical reaction. An appropriate film-forming method can be selected in accordance with the material and its productivity.

The conductive film 113*a* is formed on an exposed part in the surface of the spacer 113.

The structure of the spacer 113, position and method for arranging the spacer, and electrical connection between the face plate 112 side and that between the potential-defining electrode 105 side may be arranged arbitrarily, so far as the spacer 113 have sufficient resistibility against the atmospheric pressure and insulation resistance against the high voltage applied between the potential-defining electrode 105 and the acceleration electrode 109, and the conductive film 113*a* has surface conductivity to prevent electrical charge up and spark discharge to the spacer 113 surface.

Next, the material of the conductive connection members 107 and 108 for firmly fixing the second support members (spacers) 113 and at the same time for attaining electrical connection with the support members will be described below.

The material of the conductive connection members 107 and 108 is preferably conductive frit-glass paste made by dispersing the conductive filler into frit glass powder and mixing with a binder. The conductive filler is obtained by forming a metal film on the surface of soda-lime glass balls or silica balls having a diameter of 5 to 50 μm. The conductive connection members 107 and 108 are formed by applying and sintering the mixture paste.

In this embodiment, the conductive connection members 107 that hold the spacers 113 and electrically connect the conductive films 113*a* with the potential-defining electrode 105, and the conductive connection members 108 that hold the face plate 112 and the spacers 113, and electrically connect the acceleration electrode 109 with the conductive films 113*a* are formed by applying the conductive frit paste, mixture of gold-plated soda-lime glass or silica balls as filler with frit glass powder, and by sintering the applied paste. At this time, the average diameter of the soda-lime glass ball is 8 μm. The soda-lime glass balls are gold-plated by electroless plating. More specifically, the gold plate film comprises a base Ni film having a thickness of 0.1 μm and an Au film having a thickness of 0.04 μm. The conductive frit-glass paste is formed by mixing the conductive filler at 30 wt % with respect to the frit glass powder, then adding a binder to the mixture.

On the potential-defining electrode 105 side, the conductive frit-glass paste is applied onto the potential-defining electrode 105 by using a dispenser, thus forming the conductive connection members 107; on the face plate 112 side, the conductive frit-glass paste is applied onto the end portions of the spacers 113 by using a dispenser, thus forming the conductive connection members 108. Thereafter, on the rear plate 101 side, the conductive connection members 107 are aligned onto the wiring electrodes 103; on the face plate 112 sides, the conductive connection members 108 are aligned onto the black conductive material (black stripes), and they are sintered at 400° C. to 500° C. for ten minutes or longer in the atmosphere. This hold and connects the potential-defining electrode 105 with the face plate 112 via the spacers, and attains an electrically connection therebetween. Note that upon forming the conductive connection members 107 on the potential-defining electrode 105 side, the amount of the conductive frit-glass paste to be applied is twice of that for forming the conductive connection members 108 on the face plate side, to absorb differences in processing the respective spacers 113 and differences in assembling the spacers 113 due to a bend of the rear plate, and to enhance fixing strength. Since the conductive connection members 107 on the potential-defining electrode 105 have a little influence on the trajectories of electrons, the yield upon manufacturing the apparatus can be improved by the above assembling method.

The insulating members 104 provided under the potential-defining electrode 105 as the first support members are formed by applying insulating frit-glass paste on the row-direction wiring electrodes 103.

The row-direction wiring electrodes 103 and the column-direction wiring electrodes (not shown) are formed by screen printing Ag (silver) paste ink, drying the printed Ag (silver) paste ink at 110° C. for twenty minutes, and sintering the dried Ag (silver) paste ink at 550° C. The formed wiring electrodes have a width of 300 μm and a thickness of 7 μm. The row-direction wiring electrodes 103 and the column-direction wiring electrodes are connected to device electrodes (not shown) respectively.

Next, the thickness of the insulating members (first support members) 104 will be described. The insulating members 104 must have a thickness to ensure sufficient electric insulation between the row-direction wiring electrodes 103 and the potential-defining electrode 105. On the other hand, if the insulating members 104 are too thick, the surface area of the insulating members 104 increases, which might cause electrical charge up. Accordingly, a desirable range of the thickness of the insulating members 104 is from 1 μm or greater to 500 μm or less.

The insulating members 104 are formed by using material having a resistivity of $10^{13}$ [Ω/cm] or greater. The resistivity of the insulating members 104 is $10^{12}$ [Ω] or greater.

Next, the voltage Vc to be applied to the potential-defining electrode 105, i.e., output voltage of the power source 114 will be described.

Basically it is desirable to select a value for the voltage Vc not to influence the trajectories of electron beams even if the potential-defining electrodes exist. For this purpose, the voltage is determined from the following equation:

$$Q=(Va-Vf)\times(h+Tc/2)/H \quad (1)$$

Va: Acceleration voltage

Vf: Maximum value of drive voltage for the electron-emitting devices

H: Distance between the acceleration electrode and the electron-emitting devices (approximately equivalent to the distance between the face plate 112 and the rear plate 101)

h: Length between the electron-emitting devices and the potential-defining electrode (approximately equivalent to the thickness of the insulating members 104)

However, even within one display apparatus, the values H, h and Tc may be changed depending upon positions. For this reason, if such difference in manufacturing process is ignobly small, the value Q calculated based on designed values H, h and Tc is selected as the voltage Vc. If the difference is comparatively large, the greater the difference is, a smaller value than the Q calculated based on the designed values H, h and Tc should be selected as the voltage Vc. In a case where an actual value h is smaller than the designed value h, if the voltage Vc to be applied has a value Q calculated based on the designed values, the trajectories of electron beams are substantially influenced by the application of the voltage Vc, which might degrade image quality. Note that if too small a value Vc is selected, electrons cannot be drawn toward the fluorescent member, thus reducing efficiency of use of electrons. Accordingly, it is desirable to set the lower limit to 0.2 Q.

Then, the range of the value Vc for the value Q is determined as follows:

$$0.2\times Q \leqq Vc \leqq Q \quad (2)$$

In the first embodiment, the surface resistance of the conductive films 113*a* is $10^9$ [Ω/□]; the voltage applied to the potential-defining electrode 105, 300 V; the acceleration voltage, 6 kV; the distance H between the rear plate 101 and the face plate 112, 4 mm; the distance h between the rear plate 101 and the potential-defining electrode 105, 90 μm; and the thickness Tc of the potential-defining electrodes 105, 300 μm. The electron through holes 202 are round-shaped and the hole size is ϕ250 μm. The drive voltage for the electron-emitting devices is 14 V.

In this embodiment, the conductive film 113*a* is formed by forming a nickel oxide film on the surface of the spacers 113 comprising of purified soda-lime glass, in accordance with a vacuum evaporation method.

Note that the purified nickel oxide film is formed by sputtering with nickel oxide material as the target within argon/oxide mixed atmosphere. The temperature of the sputtering base is 250° C.

Accordingly, the structure of the present embodiment can provide an image forming apparatus that has sufficiently firm support structure against atmosphere, and that prevents luminance unevenness and color unevenness, and further prevents degradation of image quality due to cross-talk.

That is, according to the present embodiment, the conductive film 113*a* is formed on the surface of the insulating substrate 113*b*, the acceleration electrode 109 and the potential-defining electrode 105 is electrically connected via the conductive film 113*a*, and weak current is passed through the conductive film 113*a*. This can prevent degradation of image quality due to electrons and ions charged on the surface of the conductive film 113*a*.

Further, according to the present embodiment, the weak current (this current includes irregular noise) that flows through the conductive films 113*a* formed on the surface of the insulating substrate 113*b* flows to the external power source 114 via the potential-defining electrode 105. This enables the image forming apparatus to prevent bad influence upon an electron source having a large number of electron-emitting devices 102 and row-direction wiring electrodes 103.

That is, the substrate 101 and the conductive film 113*a* formed on the surface of the spacers 113 are insulated by the potential-defining electrode 105, to which a constant voltage is applied via the insulating members 104 as the first support members, provided on the rear plate 101. Specifically, the weak current that flows through the conductive film 113*a* flows to the external power source 114 via the potential-defining electrode 105 to which a constant voltage is applied, but doesn't flow to the rear plate 101 having the electron-emitting devices 102 and the row-direction wiring electrodes 103. Accordingly, this prevents the problem where a weak current flows into the electron source having the large number of. electron-emitting devices 102 and the row-direction wiring electrodes 103 upon driving the electron to drift a bias voltage of drive signals or render the waveform of the bias voltage unstable.

Next, the operation of the spacers 106 having the rectangular-prism shape, as a desirable shape, used in the present embodiment will be described with reference to FIGS. 13 and 14. In FIGS. 13 and 14, numeral 109 denotes the acceleration electrode; and 106A and 106B, support members covered with a conductive film on their surfaces. The support member 106A has a column shape, and the support member 106B, a parallelepiped shape. Numeral 105 denotes the potential-defining electrode; 1905, equipotential lines; and 1906, typical trajectories of electrons emitted from the electron-emitting devices.

On the surface of the support members, electric potential occurs by the weak current that flows there. In case of the column-shaped support member 106A (FIG. 13), the potential of the support member 106A is shifted from potential in the atmosphere occurred due to application of the acceleration voltage, which causes warp of the equipotential lines near the support member. This influences the trajectories of the electrons near the support member 106A, then the electron beams are shifted. On the other hand, in case of the parallelepiped support member 106B (FIG. 14), the potential in the atmosphere and the potential on the surface of the support member 106B are approximately equal, which does not shift the electron beams.

Figure 14:
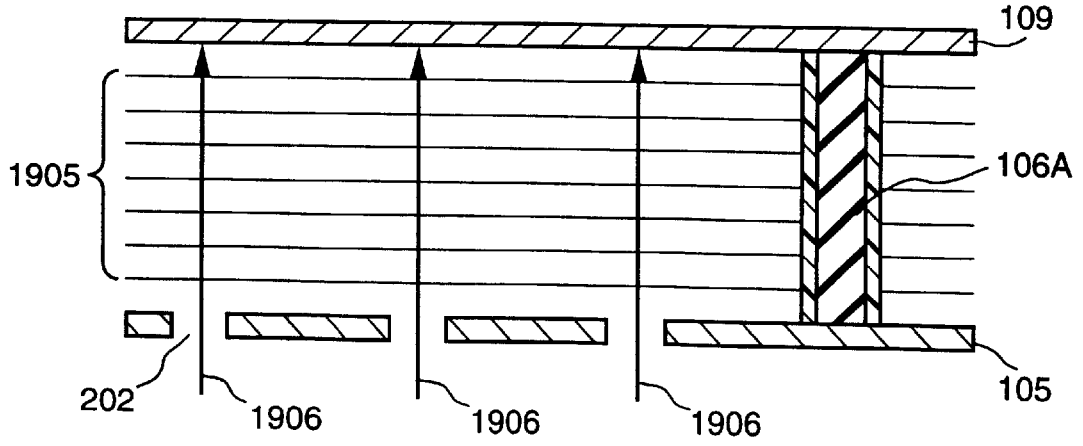

Accordingly, in the first embodiment, the support members have a parallelepiped shape as shown in FIG. 14.

Next, the electron-emitting devices 102 used in the display panel of the first embodiment will be described. There is no limitation on the material, shape and manufacturing method of the electron-emitting devices of the image display apparatus.

Accordingly, any of SCE type electron-emitting devices, FE type electron-emitting devices and MIM type electron-emitting devices can be employed.

However, when a display device having a large display screen is needed at a low price, the SCE type electron-emitting devices are especially preferable among these cold cathode electron-emitting devices. In the FE type electron-emitting device, as the relative positions of an emitter corn and a gate electrode and the shape of these parts greatly influence the electron-emitting characteristic of the device, extremely high precision manufacturing technique is required. This is disadvantageous for the purposes of a large display screen and cost down. In the MIM type electron-emitting device, the thickness of an insulating layer and an upper electrode must be thinned and unified. This is also disadvantageous for the above purposes. The SCE type electron-emitting device can be manufactured by a comparatively simple method, which easily attains the purposes of large display screen and lost costs. The inventors found that among the SCE type electron-emitting devices, especially a device where an electron-emitting portion or its peripheral parts are formed of a fine-particle film has excellent electron-emitting characteristic, and that it can be easily manufactured. Accordingly, this electron-emitting device is the most suitable to be used in a multi electron-beam source of a high-luminance, large display screen image display device. Therefore, in the display panel of the first embodiment, the SCE type electron-emitting device where the electron-emitting portion or its peripheral parts are formed of a fine-particle film. First, the basic structure, manufacturing method and characteristic of the preferred SCE type electron-emitting device will be described, and thereafter, the structure of the multi electron-beam source having a simple matrix-wired electron-emitting devices will be described.

First, a flat SCE type electron-emitting device will be described.

Figure 9A:
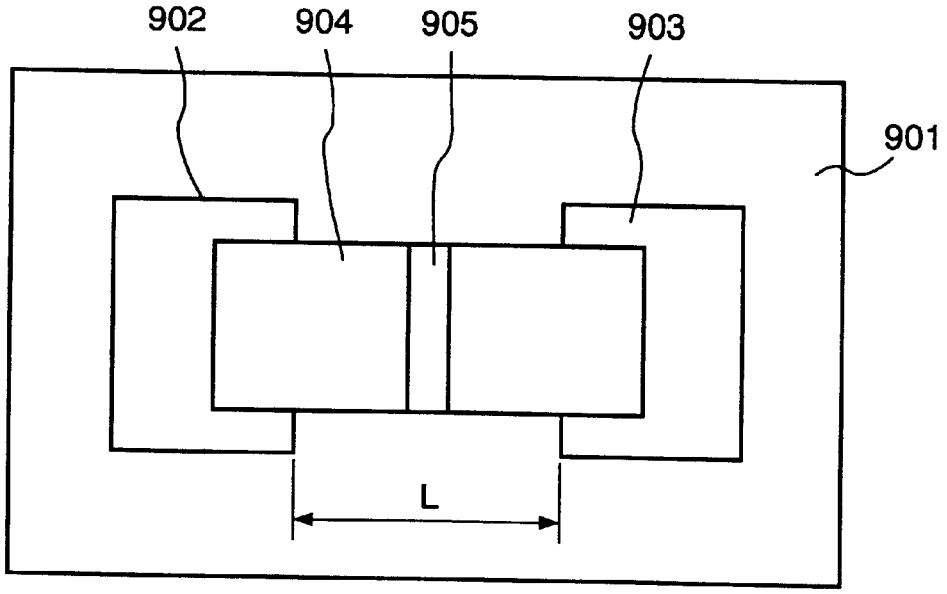
FIG. 9A is a plan view schematically showing a flat SCE type electron-emitting device of the present invention.
Figure 9B:
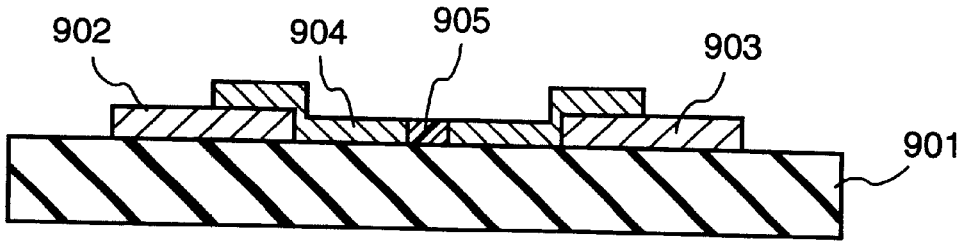
FIG. 9B is a cross-sectional view of the flat SCE type electron-emitting device in FIG. 9A.

FIGS. 9A and 9B are a top view and cross-sectional view showing the basic structure of the flat SCE type electron-emitting device. In FIGS. 9A and 9B, numeral 901 denotes a substrate; 902 and 903, device electrodes; 904, a conductive thin film; and 905, an electron-emitting portion.

As the substrate 901, glass substrates of glass where impurities are reduced, such as quartz glass and soda-lime glass plate on which an $SiO_2$ film is accumulated by sputtering, ceramics such as alumina can be employed.

The material of the device electrodes 902 and 903 opposing each other may be selected from general conductive materials, e.g., metals such as Ni, Cr, Au, Mo, W, Pt, Ti, Al, Cu and Pd metal oxides such $RuO_2$, alloys such a Pd—Ag, printing conductive member comprising of glass and the like, transparent conductors such as $In2O_3$—$SnO_2$, and semiconductors such as polysilicon.

An interval L between the device electrodes 902 and 903, the length of the device electrodes, the shape of the conductive thin film 904 are appropriately designed in accordance with the application of the electron-emitting device. Preferably, the interval L between the device electrodes is hundreds Å to hundreds $\mu$m, and more preferably, several $\mu$m to tens $\mu$m in accordance with a voltage applied between the device electrodes.

Note that the order or accumulating the conductive thin film 904 and the device electrodes 902 and 903 is not limited to that shown in FIGS. 9A and 9B. For example, the conductive thin film 904, then the device electrode 902, and the device electrodes 903, may be accumulated on the substrate 901.

To obtain excellent electron-emitting characteristic, it is specifically preferable that the conductive thin film 904 is a fine-particle film containing fine particles. The thickness of the film is appropriately set in accordance with the step coverage to the device electrodes 902 and 903, the resistance between the device electrodes 902 and 903 and the above-described condition for forming processing. Preferably, the thickness is several Å to thousands Å, and more preferably, it is 10 Å to 500Å, and its sheet resistance is to $10^5$ to $10^{13}$ [Ω/□].

The material of the conductive thin film 904 may be metals such as Pd, Ru, Ag, Au, Ti, In, Cu, Cr, Fe, Zn, Sn, Ta, W and Pb, oxides such as PdO, $SnO_2$, $In_2O_3$ and $Sb_2O_3$, borides such as $HfB_2$, $ZrB_2$, $LaB_6$, $CcB_6$, $YB_4$ and $GdB_4$, carbides such as TiC, ZrC, HfC, TaC, SiC and WC, nitrides such as TiN, ZrN and HfN, semiconductors such as Si and Ge, and carbons.

Note that the fine-particle film is a mass of fine particles, in diffused state or in contact/overlapped state (including island-like particle groups). The diameter of the fine particle is several Å to thousands Å, and preferably, 10 to 200 Å.

The electron-emitting portion 905 is, e.g., a fissure having high resistance formed at a part of the conductive thin film 904, by energization forming. The conductive thin film 904 may have conductive fine particles having diameters of several Åto hundreds Å. The conductive fine particles contain a part or all of the materials of the conductive thin film 904. The electron-emitting portion 905 and its peripheral conductive thin film 904 may have carbons and/or carbides.

Next, a stepped SCE electron-emitting device will be described.

Figure 10:
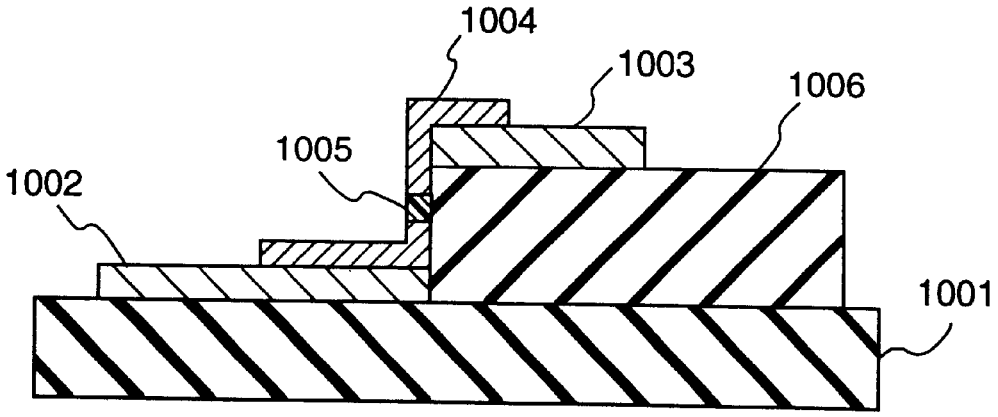
FIG. 10 is a cross-sectional view showing a stepped SCE type electron-emitting device of the present inventions

FIG. 10 is a cross-sectional view showing the basic structure of the stepped SCE type electron-emitting device.

A substrate 1001, device electrodes 1002 and 1003, a conductive thin film 1004 and electron-emitting portion 1005 are formed with materials respectively the same as those described above. A rack 1006 (for height difference between the electrodes 1002 and 1003) comprises of an insulating material such as $SiO_2$ formed by vapor-evaporation, printing or sputtering. The thickness of the rack 1006 is hundreds Å to tens Å in correspondence with the interval L between the device electrodes 1002 and 1003. The thickness is appropriately set in accordance with a manufacturing method and a voltage applied to between the device electrodes, and preferably, it is hundreds Å to several Å.

The conductive thin film 1004 is formed after the device electrodes 1002 and 1003 and the rack 1006 have been formed, on the device electrodes 1002 and 1003. Note that the electron-emitting portion 1005 is shown as a transversal line portion on the rack 1006. The shape and position of the electron-emitting portion 1005 is not limited to this structure, but they can be changed in correspondence with the condition for formation of the electron-emitting portion or the condition for the above-described forming.

Figure 19:
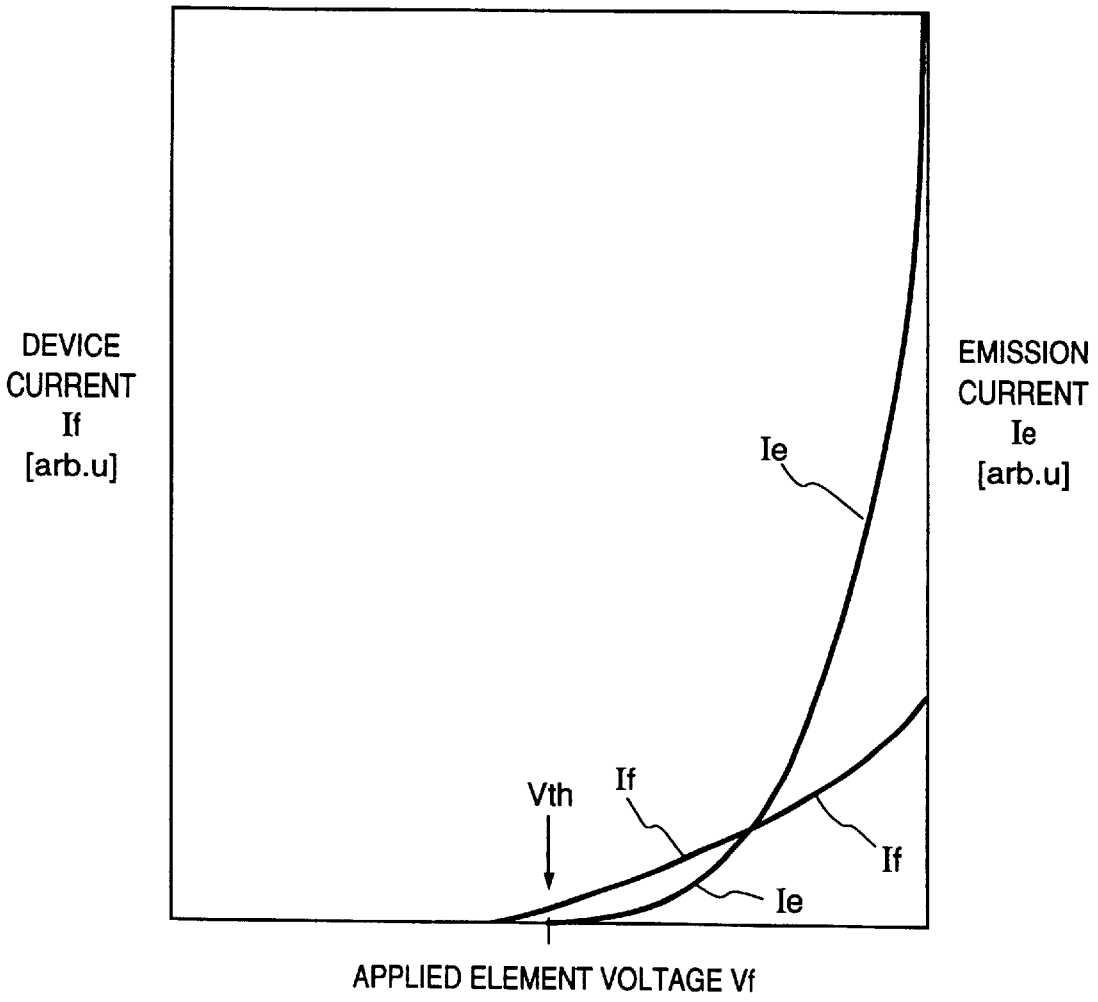
FIG. 19 is a line graph showing the relation between emission current Ie from the electron-emitting device, device current If and device voltage Vf, measured by a measurement and estimation device.

FIG. 19 shows the following three characteristics of the SCE type electron-emitting device having the structure in FIG. 10: (1) if a device voltage Vf applied to an electron-emitting device exceeds a threshold value Vth, an emission current Ie drastically increases; when the device voltage Vf is at the threshold value Vth or lower level, the emission current Ie is almost not detected. That is, the electron-emitting device has a non-linear emitting characteristic with a clear threshold voltage value with respect to the emission current; (2) since the emission current monotonously increases with respect to the device voltage, the emission current Ie can be controlled by the device voltage Vf; (3) the amount of emission charge captured at an acceleration electrode can be controlled by voltage-applying time because it depends on time for applying the device voltage.

Preferably, the drive operation for the above SCE type electron-emitting device is made within high vacuum atmosphere of, e.g., $10^6$ torr or greater.

Next, the construction of a multi electron-beam source having simple-matrixed SCE type electron-emitting devices as above will be described.

Figure 11:
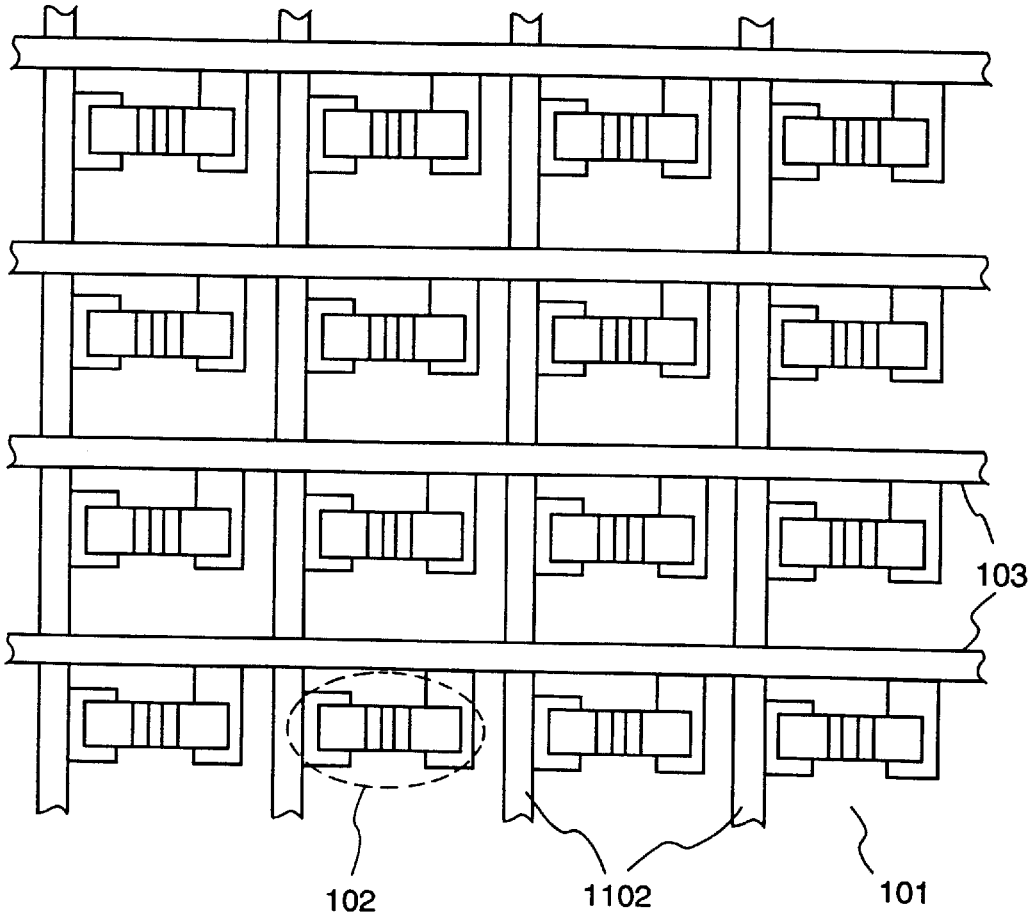
FIG. 11 is a plan view showing a multi electron source of the present invention.

FIG. 11 shows a plan view of the multi electron-beam source. On its device substrate, the SCE type electron-emitting devices 102 as shown in FIG. 10 are arranged into a simple matrix with the row-direction wiring electrodes 103 and column-direction wiring electrodes 1102. At the intersections of the row-direction wiring electrodes 103 and column-direction wiring electrodes 1102, an insulating layer (not shown) is formed so as to maintain electrical insulation.

Next, the method for driving the multi electron-beam source upon image display will be described with reference to FIGS. 16 to 18.

As described using FIG. 19, the electron-emitting device of the present invention has the following basic characteristic with respect to the emission current Ie. That is, as it is apparent from the graph of FIG. 19, the electron emission has the clear threshold value Vth (8 V in the present embodiment) for emitting electrons, and electron emission occurs only when a voltage greater than the threshold value Vth is applied.

Further, with respect to the voltage greater than the threshold value Vth, the emission current Ie changes in correspondence with the change of the voltage. Note that the threshold value Vth and the amount of change of emission current Ie may vary by changing the structure and manufacturing method of the electron-emitting device. In any case, however, it is understood that when a pulse voltage is applied to the present electron-emitting device, if the voltage value is equal to the threshold value (8 V) or less, electron emission does not occur, while if the voltage value is greater than the threshold value, electron-beam is outputted.

Figure 16:
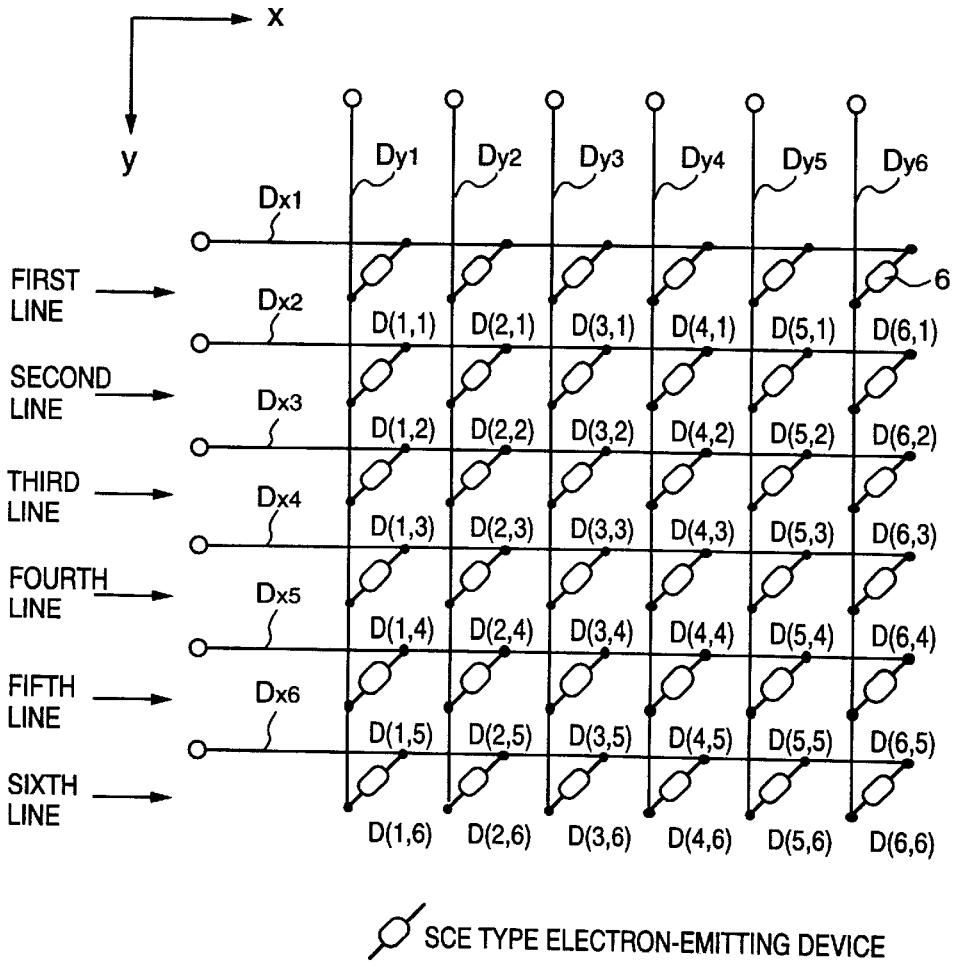
FIG. 16 is an example of a simple arrangement of electron-emitting devices of the image forming apparatus of the present invention.

FIG. 16 shows the electron-beam source having electron-emitting devices 6 arranged into a 6 rows×6 columns matrix. For the sake of explanation, the respective devices are identified with .(X,Y) coordinates such as D(1,1), D(1,2) and D(6,6).

Note that for the convenience of illustration, the pixels of a display panel of the image forming apparatus are 6×6 (m=n=6). However, actual display panel has far more pixels.

Upon driving the electron-beam source for image display, an image is formed on line base, i.e., by each line parallel to the X axis as the unit of image formation. To drive the electron-emitting devices 6 corresponding to a line of an image, a voltage of 0 V is applied to the terminals of a row corresponding to the display line, out of the rows D×1 to D×6, while a voltage 7 V is applied to the other terminals. In synchronization with this operation, a modulation signal is applied to respective terminals Dy1 to Dy6, in accordance with an image pattern of the display line.

Figure 17:
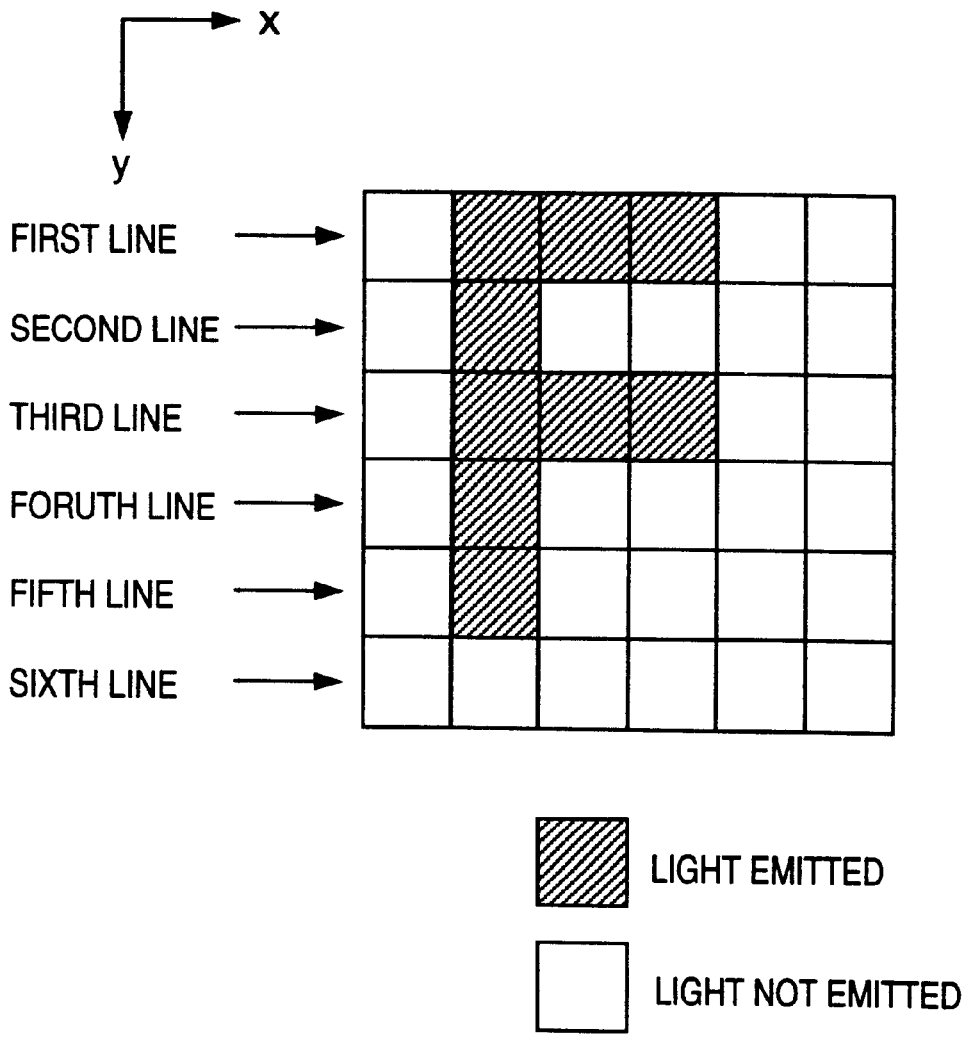
FIG. 17 is a sample image for image formation of the present invention.

Next, display of an image pattern as shown in FIG. 17 will be described.

Figure 18:
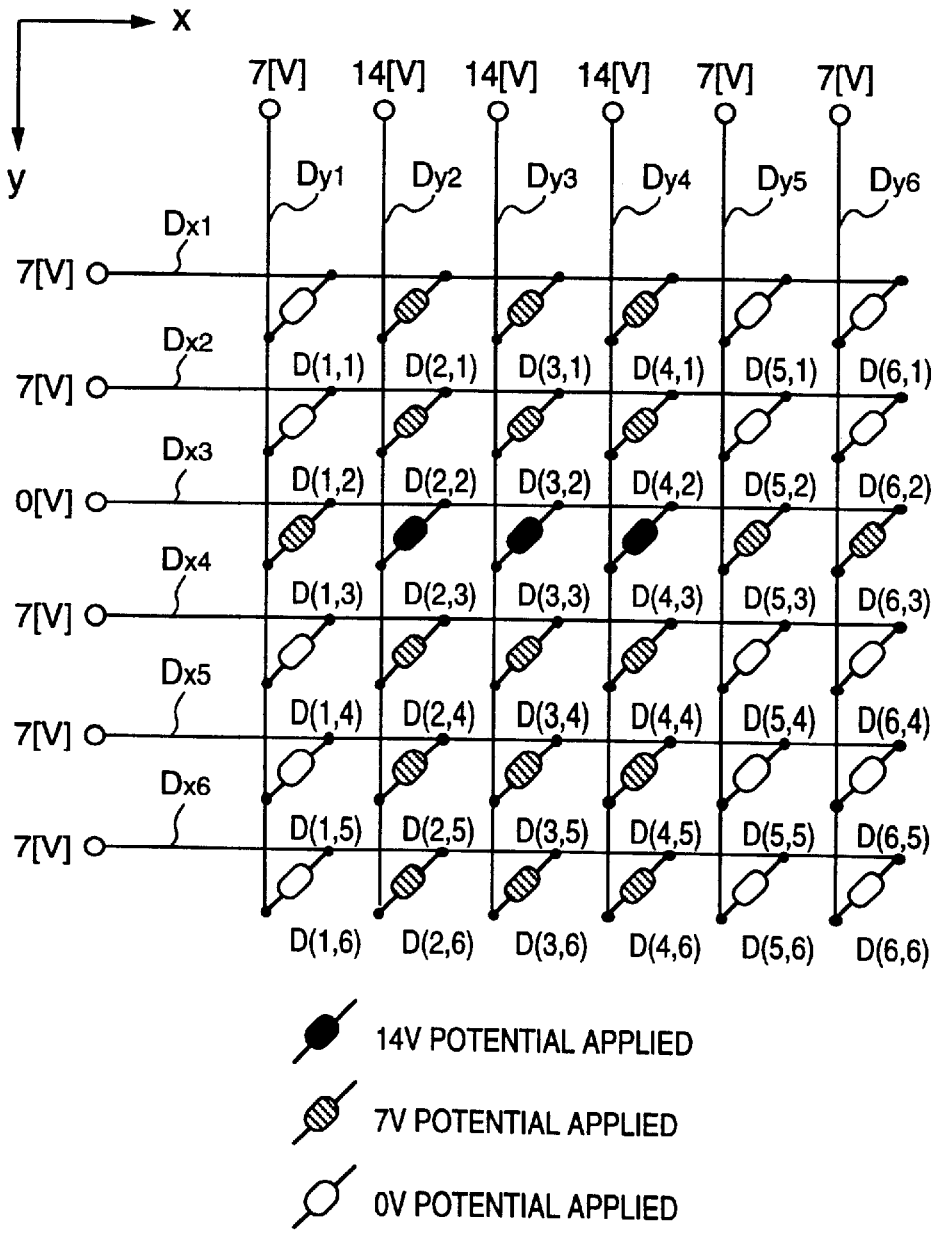
FIG. 18 is an explanatory view showing a driving method using the sample image in FIG. 17.

FIG. 18 shows the voltage values applied to the electron-beam source through the terminals D×1 to D×6 and Dy1 to Dy6 while the third line of the image pattern in FIG. 17 is displayed. The electron-emitting devices D(2,3), D(3,3) and D(4,3) (black devices in FIG. 18) receive a voltage of 14 V over the threshold 8 V and emit electron beams. On the other hand, the other electron-emitting devices than these three devices receive a voltage of 7 V (hatched devices) or 0 V (blank devices), less than the threshold 8 V, and these electron-emitting devices do not emit electron beams.

Similarly, the electron-beam source is driven regarding the other lines, on line base, sequentially from the first line, thus display of an image for one image frame is performed. This is repeated at 60 frames/sec speed, thus image display without flicker.

Although not described above, display of gradation is made by, e.g., varying the pulsewidth of the voltage to be applied to the electron-emitting devices.

Next, the method for driving the above image forming apparatus will be described with reference to FIG. 15.

Figure 15:
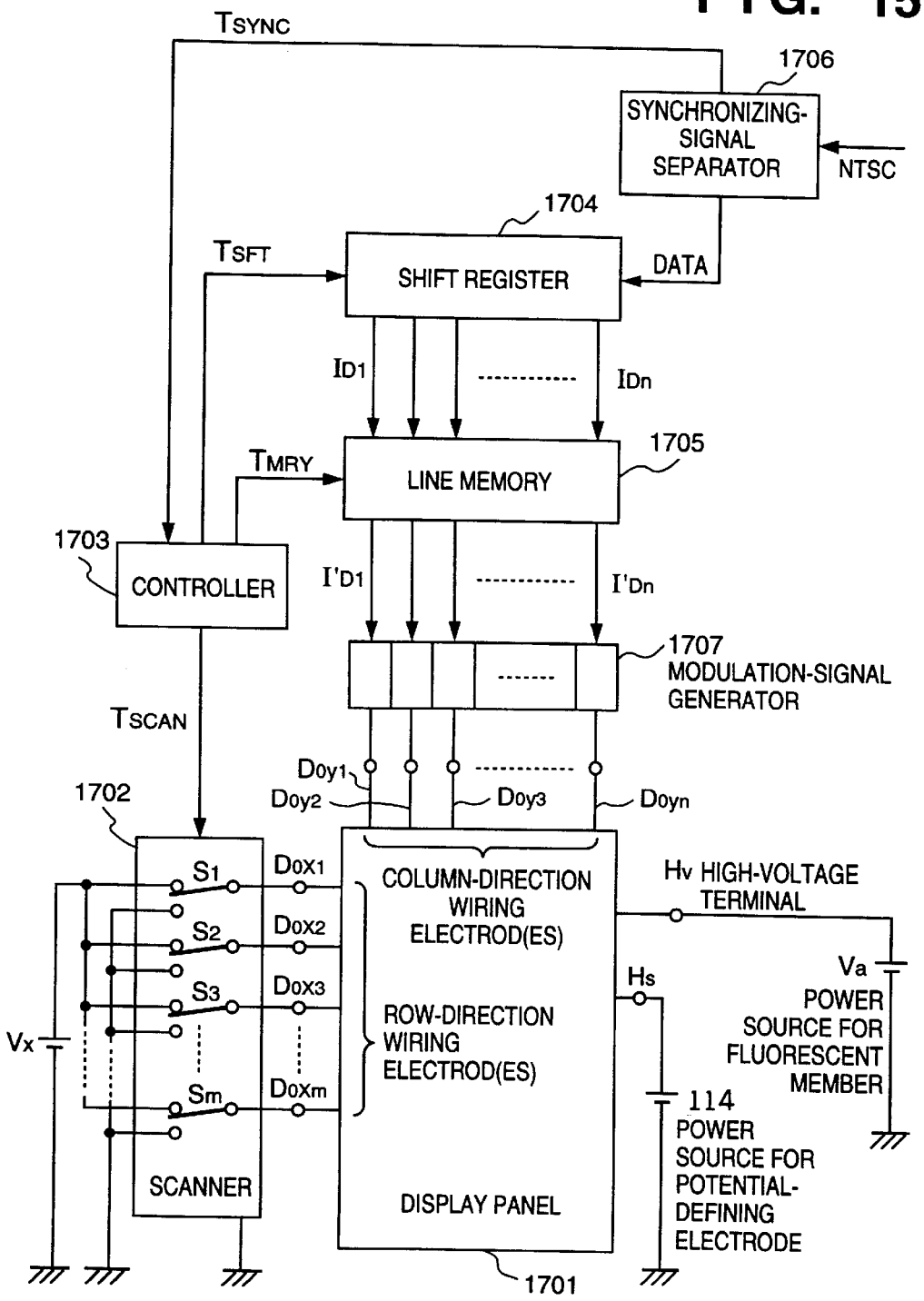
FIG. 15 is a block diagram showing the construction of a driver of the image forming apparatus of the present invention.

FIG. 15 is a block diagram showing the construction of a driver for television display in accordance with a TV signal based on the NTSC standards. In FIG. 15, a display panel 1701 is manufactured as above, and it operates as above. A scanner 1702 scans a display line. A controller 170S generates signals to be inputted into the scanner 1702. A shift register 1704 shifts data by each line. A line memory 1705 inputs one-line data from the shift register 1704 into a modulation-signal generator 1707. A synchronizing-signal separator 1706 separates a synchronizing signal from the NTSC signal.

The functions of the respective devices in FIG. 15 will be described in detail.

First, the display panel 1701 is connected with external electric signals via terminals Dox1 to Doxm and Doy1 to Doyn, a terminal Hs and a high-voltage terminal Hv. A scan signal for sequentially driving the m×n matrix electron-emitting devices by one line (n devices) is applied to the terminals Dox1 to Doxm as an electron-beam source provided in the display panel 1701.

On the other hand, modulation signals, for controlling output-electron beams from the respective electron-emitting devices of the line selected by the scan signal, are applied to the terminals Doy1 to doyn. The high-voltage terminal Hv must have a high direct-current voltage of e.g. 5 kV from a direct-current power source Va, for supplying energy to the electron beams outputted from the electron-emitting devices to excite the fluorescent member.

Further, a voltage of 300 [V] from the power source 114 is applied to the potential-defining electrode 105 via the terminal Hs.

Next, the scanner 1702 will be described.

The scanner 1702 has m switching devices (denoted as S1 to Sm in FIG. 15) which select the output voltage of a direct-current power source Vx or 0 V (ground level) and connect the selected voltage with the terminals Dox1 to Doxm of the display panel 1701. The switching devices S1 to Sm operate based on a control signal Tscan outputted from the controller 1703. Actually, these switching devices can be easily constructed by combining switching devices such as FET's.

Note that the direct-current power source Vx is set to output a constant voltage of 7 V so that the drive voltage applied to the electron-emitting devices is the threshold value Vth or less.

The controller 1703 adjusts the operations of the respective devices so that appropriate display can be made based on an image signal inputted from the external device. The controller 1703 generates the respective control signals, Tscan, Tsft and Tmry to the respective devices, in accordance with a synchronizing signal Tsync sent from the synchronizing-signal separator 1706.

The synchronizing-signal separator 1706 can be easily constructed by using a synchronizing-signal component (filter) circuit for handling the NTSC-standard TV signal inputted from the external device. As it is well known, the synchronizing signal separated by the synchronizing-signal separator 1706 includes a vertical synchronizing signal and a horizontal synchronizing signal, however, the synchronizing signal is shown as the signal Tsync for the convenience of explanation. Similarly, a luminance-component signal separated from the TV signal, inputted into the shift register 1704, is shown as signal DATA for the convenience of explanation.

The shift register 1704 serial/parallel converts the serially-inputted signal DATA, by each line of an image, based on the control-signal Tsft sent from the controller 1703. That is, the control signal Tsft functions as a shift clock of the shift register 1704.

The serial/parallel converted data for one image line is outputted from the shift register 1704 as a signal inputted into the line memory 1705 comprising n memories Id1 to Idn.

The line memory 1705 holds data for one image line f or a necessary period. It appropriately holds the contents of the memories Id1 to Idn in accordance with the control signal Tmry sent from the controller 1703. The stored contents are outputted as image data I'd1 to I'dn into the modulation-signal generator 1707.

The modulation-signal generator 1707 appropriately modulates the electron-emitting devices respectively, in accordance with the image data I'd1 to I'dn. The output signals from the modulation-signal generator 1707 are applied to the electron-emitting devices of the display panel 1701 via the terminals Doy1 to Doyn.

[Second Embodiment]

Figure 3:
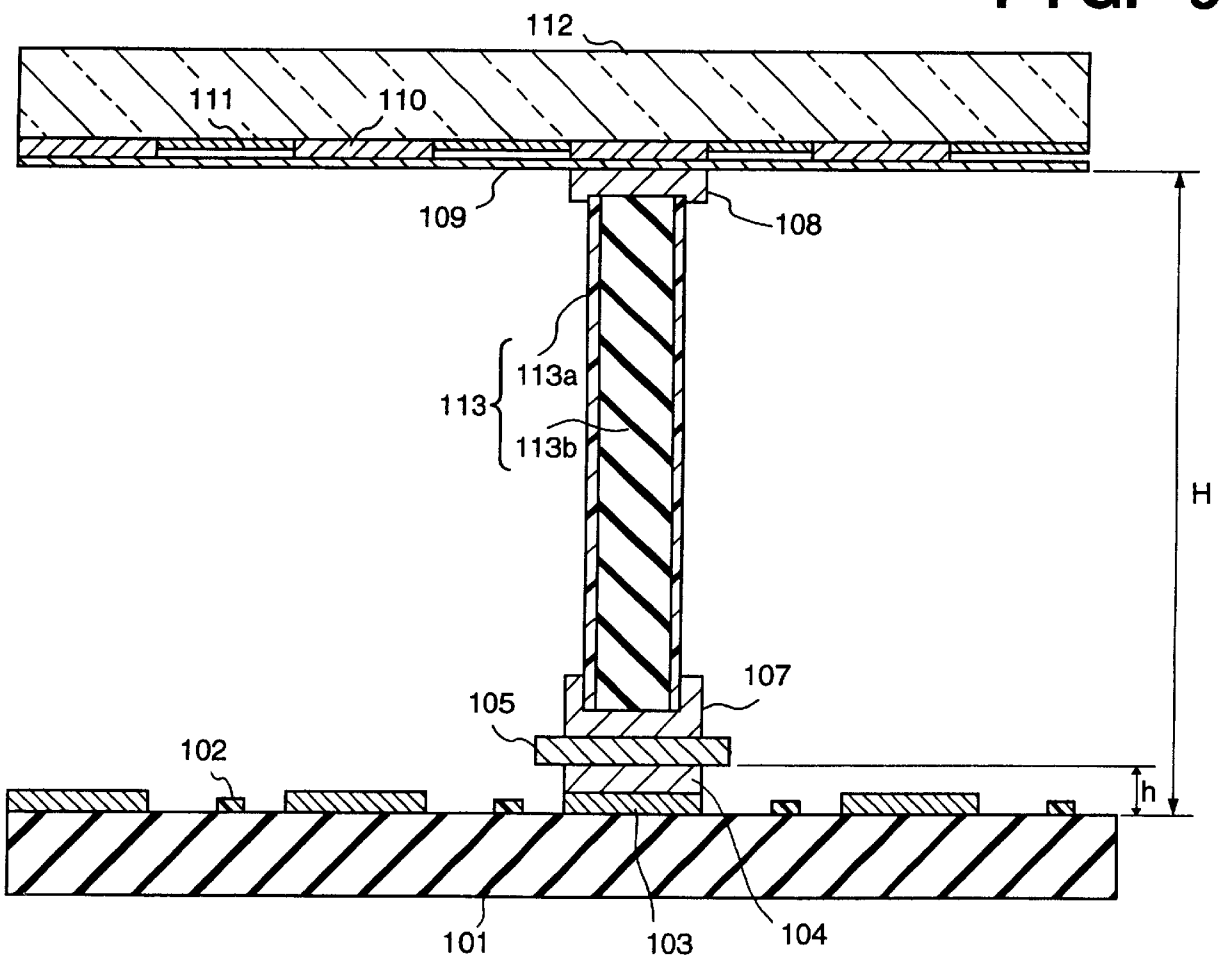
FIG. 3 is a cross-sectional view showing another example of the image forming apparatus of the present invention.

FIG. 3 shows an image forming apparatus using the SCE type electron-emitting devices according to the second embodiment of the present invention. The present embodiment differs from the first embodiment, in that the potential-defining electrode 105 are formed only between the spacers 113 as the second support members, covered with the conductive films 113*a*, and the row-direction wiring electrodes 103. As the other parts of the structure are the same as those in the first embodiment, the explanation of those parts will be omitted. It has been confirmed the present embodiment has similar advantageous features to those in the first embodiment.

[Third Embodiment]

Figure 4A:
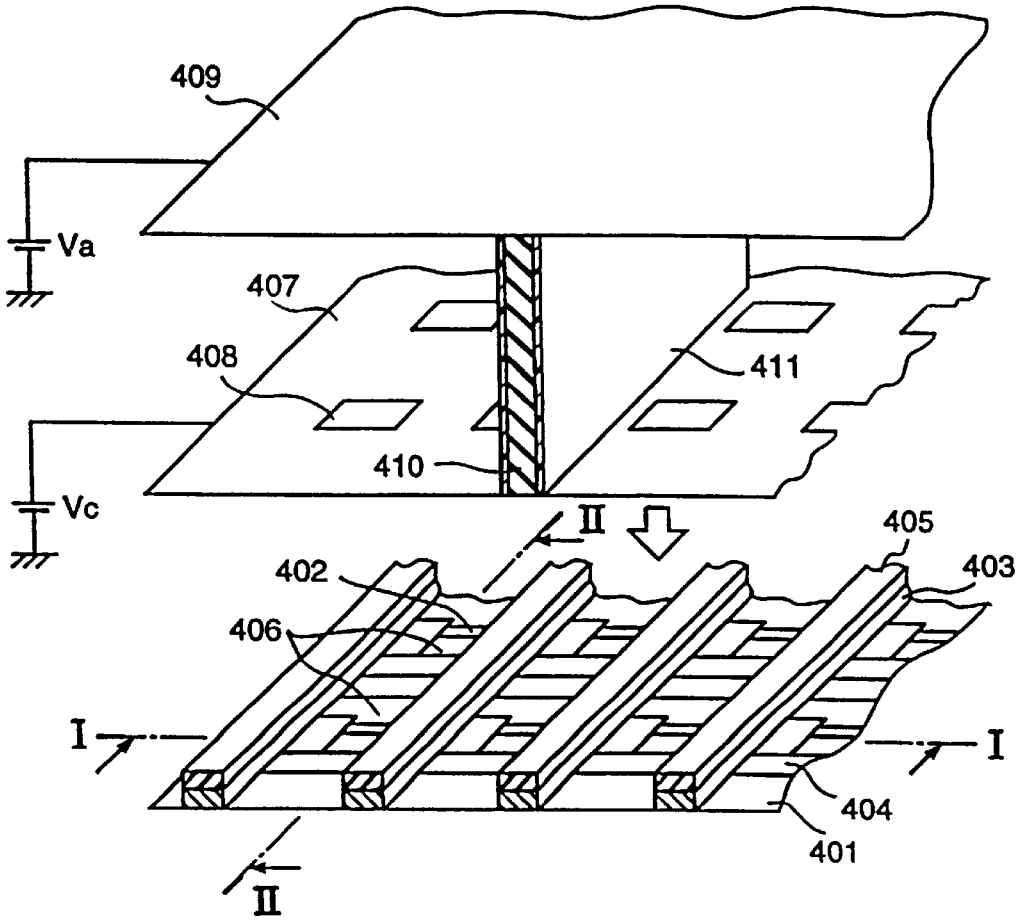
FIG. 4A is an explanatory perspective view showing another example of the image forming apparatus of the present invention.
Figure 4B:
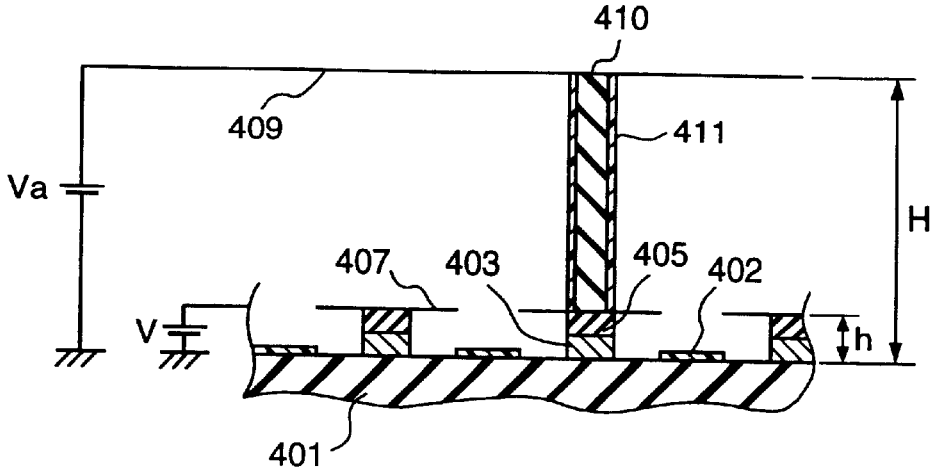
FIG. 4B is a cross-sectional view cut along a line I—I in FIG. 4A.
Figure 4C:
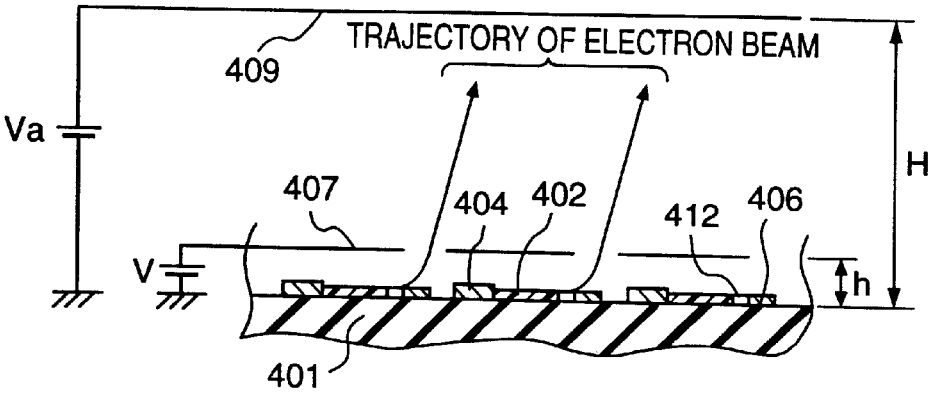
FIG. 4C is a cross-sectional view cut along a line II—II in FIG. 4A.
Figure 5:
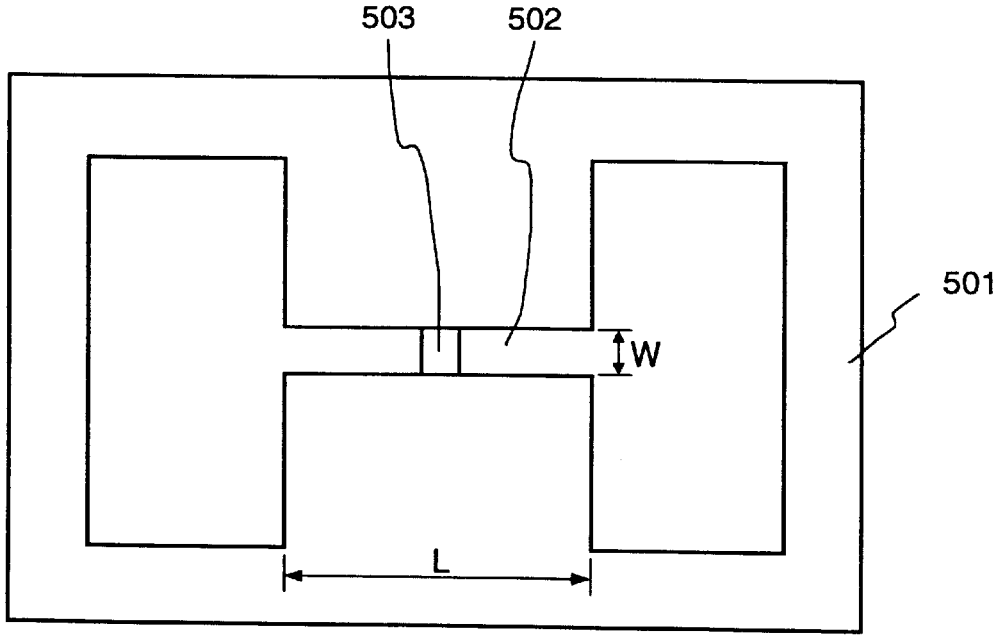
FIG. 5 (PRIOR ART)
FIG. 5 is a plan view schematically showing the conventional SCE type electron-emitting device.
Figure 6:
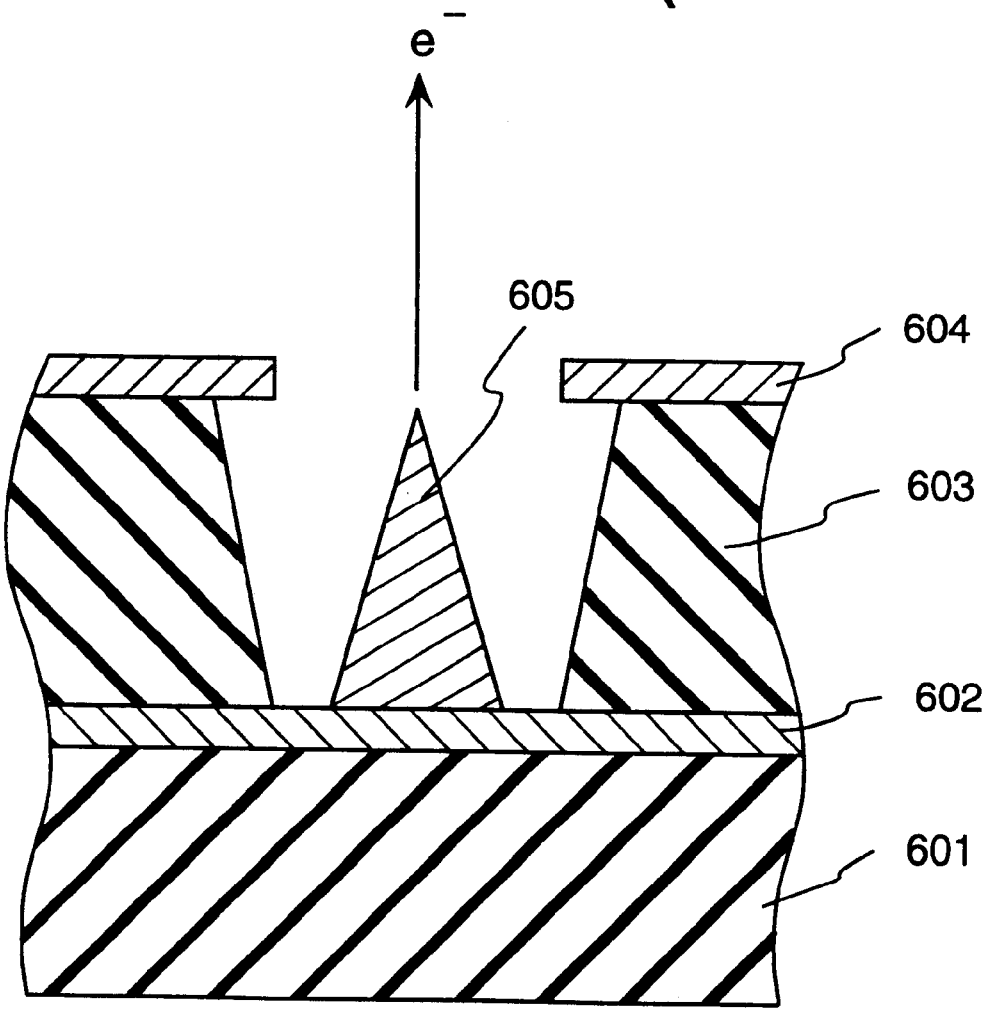
FIG. 6 (PRIOR ART)
FIG. 6 is a cross-sectional view schematically showing the conventional FE type electron-emitting device.
Figure 7:
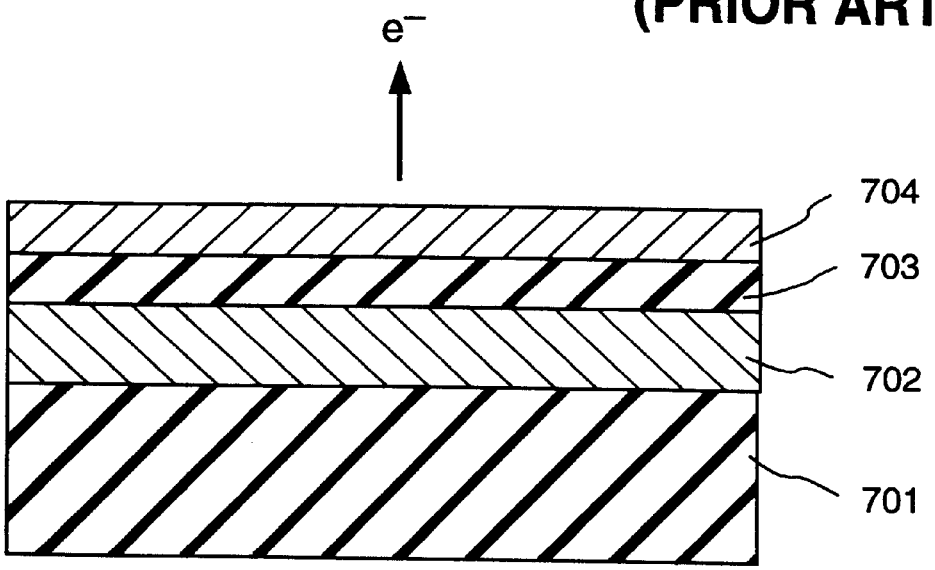
FIG. 7 (PRIOR ART)
FIG. 7 is a cross-sectional view schematically showing the conventional MIM type electron-emitting device.
Figure 8:
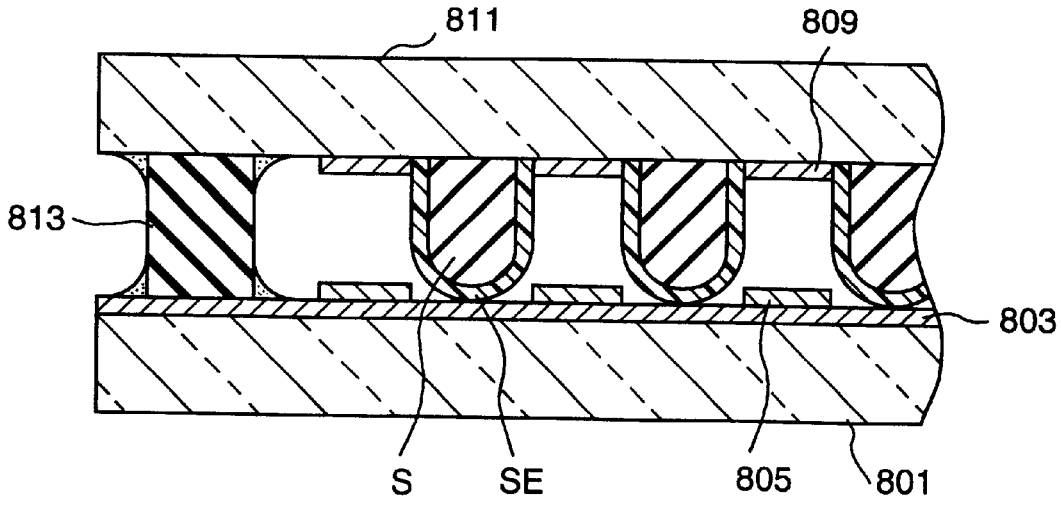
FIG. 8 (PRIOR ART)
FIG. 8 is a cross-sectional view showing the conventional image display device.

FIG. 4A shows a schematic perspective view of the image forming apparatus according to the third embodiment of the present invention. FIGS. 4B and 4C show cross-sectional views cut along a lines I—I and II—II in FIG. 4A respectively. In these figures, numeral 401 denotes a substrate; 404, column-direction wiring electrodes; 403, row-direction wiring electrodes formed on the column-direction wiring electrodes 404 via a insulating layer (not shown); 405, an insulating layer of frit glass; and 402, electron-emitting devices respectively having an electron-emitting portion 412. The electron-emitting devices 402 are electrically connected with the row-direction wiring electrodes 403 and the column-direction wiring electrodes 404, formed by screen printing silver (Ag) paste ink, via connection lines 406. Numeral 407 denotes a potential-defining electrode provided on the row-direction wiring electrodes 403 via the insulating layer 405. Different from the first embodiment, the potential-defining electrode 407 of this embodiment covers above the respective electron-emitting portions 412, and it has electron through holes 408 (FIG. 4C) not to block electron beams emitted from the electron-emitting portions 412 of the electron-emitting devices 402. Further, insulating spacers 410, covered with conductive films 411 are provided between the substrate 401 and an acceleration electrode 409. As the materials of the respective parts of the image forming apparatus of the present embodiment are the same as those in the first embodiment, the explanation of the materials will be omitted. In the third embodiment, an interval H between the substrate 401 and the acceleration electrode 409 is 5 mm; an acceleration voltage applied to the acceleration electrode 409, 5 kV; and voltage applied between the device electrodes, 14 V. The potential-defining electrode 407 has a thickness of 5 $\mu$m and is provided at a height h of 80 $\mu$m above the electron-emitting devices 402, and the electron through holes 408, having a 220 $\mu$m×110 $\mu$m rectangular shape, are arranged at positions shifted from the positions directly above the electron-emitting portions 412 by 60 $\mu$m. As the shape of the electron-emitting portions 402 is a line having a length of 100 $\mu$m, the size of the electron through holes is sufficient to pass electron beams without colliding with the potential-defining electrode 407. Note that the spacial voltage at a position 80 $\mu$m (height h) above from the substrate 401 when the potential-defining electrode 407 does not exist is 80 V.

In this embodiment, when the potential-defining electrode 407 receives a voltage of 15 V, the spot diameter of an electron beam that irradiates the acceleration electrode 409 is about 60% of that in a case where the potential-defining electrode 407 is not provided, which realizes image display with higher precision. When a voltage of 35 V is applied to the potential-defining electrode 407, the spot diameter of the electron beam is approximately the same as that of the case where the voltage of 15 V is applied to the potential-defining electrode 407, which obtains a brighter spot. When a voltage of 75 V is applied to the potential-defining electrode 407, the spot diameter of the electron beam is about 90% of that in the case where the potential-defining electrode 407 is not provided.

As the potential-defining electrode 407 covers above the electron-emitting portions 412, the damage at the electron-emitting portions due to ion collision can be reduced, thus the life of the electron-emitting devices can be longer than that of the first embodiment. In the present embodiment, it is most preferable that the voltage applied to the potential-defining electrode 407 is 35 V, in consideration of the spot diameter and the brightness of the spots of the electron beams.

[Fourth Embodiment]

Figure 12:
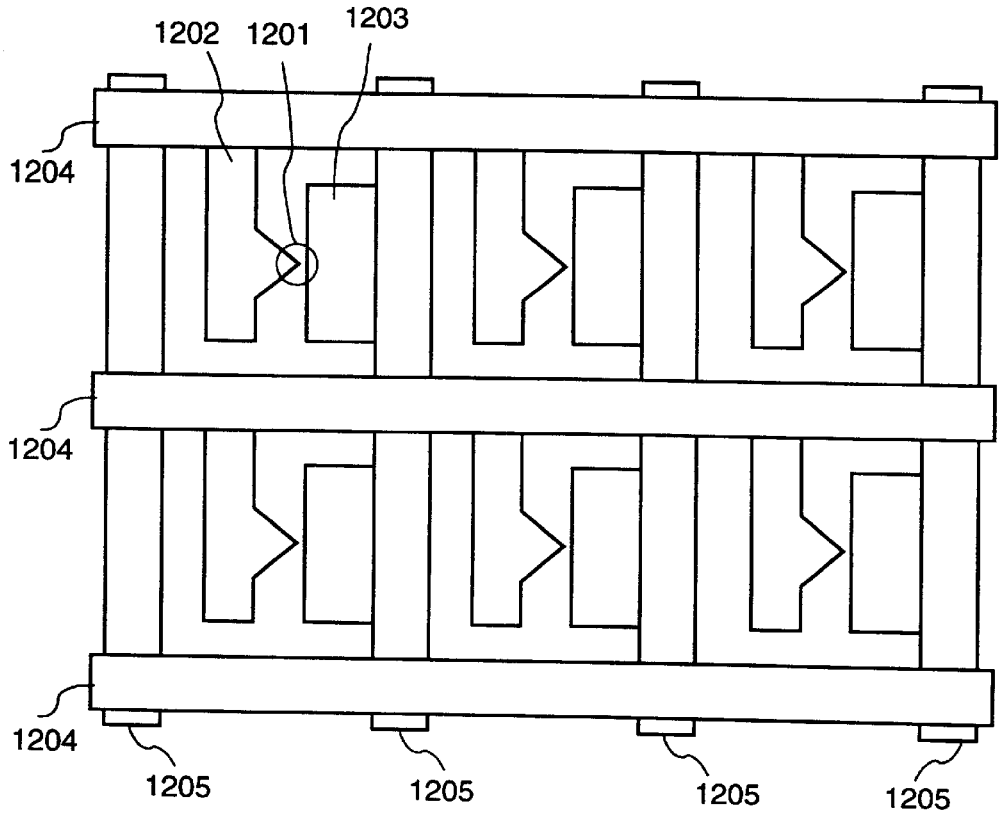
FIG. 12 is a plan view showing a flat,FE type electron-emitting devices of the present invention.

This embodiment differs from the first embodiment in that flat FE type electron-emitting devices are employed. FIG. 12 shows a top plan view of the flat FE type electron-emitting devices. In FIG. 12, numeral 1201 denotes electron-emitting portions; 1202 and 1203, pairs of device electrodes; 1204, row-direction wiring electrodes; and 1205, column-direction wiring electrodes. When a voltage is applied a between the device electrodes 1202 and 1203, the sharp tips of the electron-emitting portions 1201 emit electrons. The column-direction wiring electrodes 1205 are formed by forming grooves (not shown) on the substrate, applying Ag (silver) paste into the grooves by using a blade coater and sintering the paste. Next, after an insulating layer (not shown) is formed over the substrate, the row-direction wiring electrodes 1204 are formed by screen printing similar to that of the first embodiment. The thickness of the column-direction wiring electrodes 1205 is 50 $\mu$m; and that of the row-direction wiring electrodes 1204, 60 $\mu$m. The other parts of the image forming apparatus are the same as those in the first embodiment.

Further, the electron-emitting portions 1201 of the flat FE type electron-emitting devices used in the present embodiment have high-melting point metal or diamond.

Thus, the present embodiment can provide an image forming apparatus which has a support structure sufficiently firm against atmospheric pressure, and prevents problems of luminance unevenness, color unevenness, degradation of image quality due to cross-talk, spark discharge, and degradation of modulation circuit or electron-emitting devices.

[Fifth Embodiment]

Figure 20:
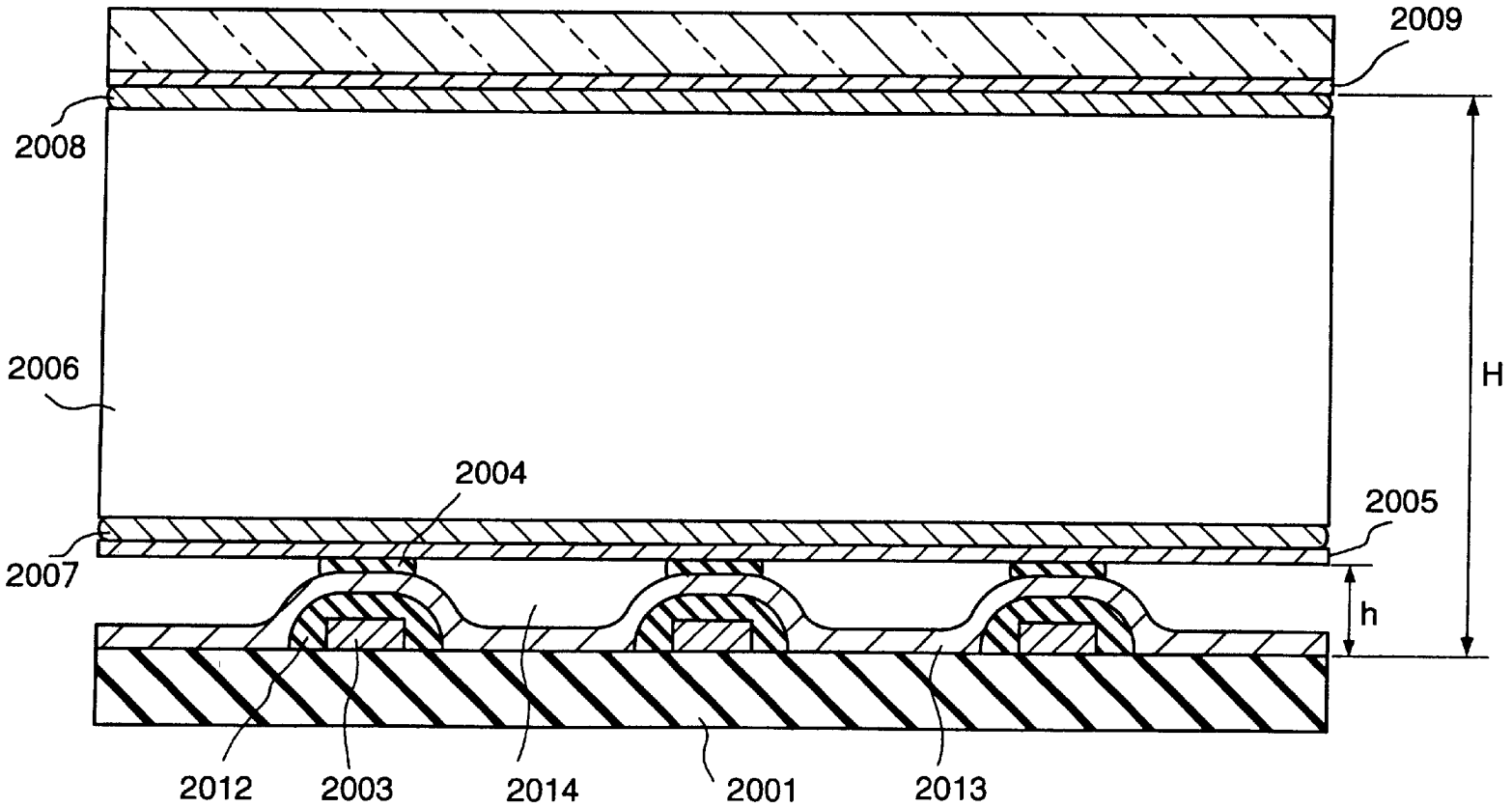
FIG. 20 is a cross-sectional view showing another example of the image forming apparatus of the present invention.
Figure 21:
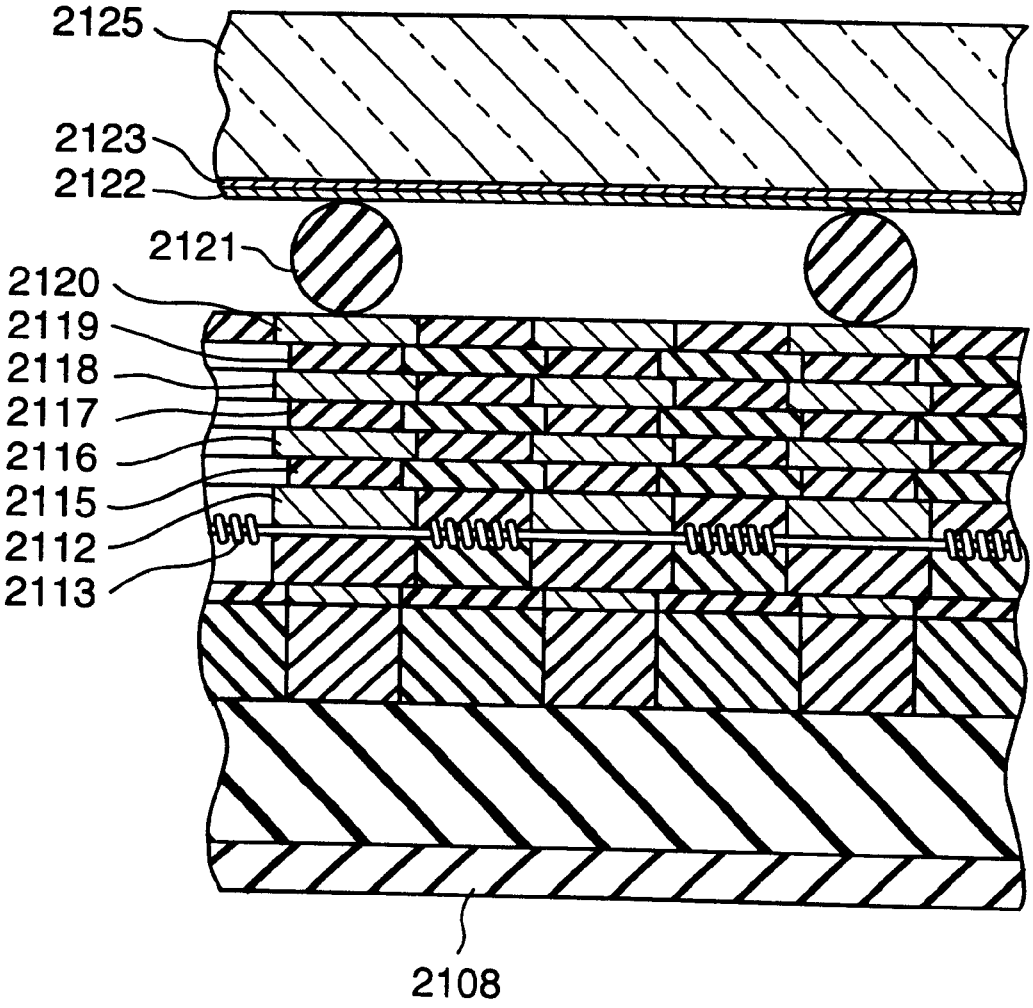
FIG. 21 (PRIOR ART)
FIG. 21 is a cross-sectional view showing-the conventional image forming apparatus.

FIG. 20 shows an image forming apparatus using the SCE type electron-emitting devices according to the fifth embodiment. In this embodiment, at intersections of row-direction wiring electrodes 2003 and column-direction wiring electrodes 2013, spaces 2014 are formed by increasing the thickness of the wiring electrodes. The spacers 2014 improves air-exhaustion speed at air exhausting process in manufacturing the image forming apparatus, and improves the life of the apparatus by virtue of improvement of attained vacuum condition. In this embodiment, the thickness of the row-direction wiring electrodes 2003 is 50 $\mu$m; the thickness of an insulating layer 2012 between the row- and column-direction wiring electrodes, 60 $\mu$m; and the thickness of the column-direction wiring electrodes 2013, 80 $\mu$m. Numeral 2006 denotes a conductive spacer; and 2007 and 2008, conductive connection members.

In the present embodiment, an interval H between a device substrate 2001 and an acceleration electrode 2009 is 6 mm; an acceleration voltage applied to the acceleration electrode 2009, 7 kV; a voltage applied between device electrodes is 14 V; a distance h between the device substrate 2001 and a potential-defining plate 2005, 150 $\mu$m; the thickness of the potential-defining plate 2005, 300 $\mu$m; and a voltage applied to the potential-defining plate 2005, 150 V. The image forming apparatus having the above construction can obtain the same advantageous features as those in the first embodiment. Further, upon forming this apparatus, the air-exhaustion time is shortened by 5%, and the life of the apparatus is lengthened by 10% with respect to the air exhaustion time and the life of other image forming apparatuses. Note that the resistance value of the wiring electrodes is 5 Ω or less; that of insulating layers 2004 between the wiring electrodes 2003 and 2013 and the potential-defining plate 2005 is $10^{12}$ Ω or greater.

Next, sixth to tenth embodiments of the present invention will be described. These embodiments commonly have a feature that the first support members (i.e., members which support between the potential-defining electrode and the row-direction wiring electrodes) as well as the second support members have conductivity.

In consideration of the facts that electrical charge up and spark discharge do not occur at the first support members so often as at the second support members, that the electron-emitting devices and the modulation circuit should preferably be provided away from noise caused by the second support members, and that the electric consumption by the first support members should preferably be saved, the conductivity of the first support members is limited to a certain level. That is, the electric resistance of the first support members is greater than that of the second support members by ten times or more. Most preferably the resistance of the first support member is 100 times or more greater.

More specifically, as the electric resistance of the first support members (i.e., the electric resistance between the potential-defining electrode and the row-direction wiring electrodes), an appropriate value is selected from a range of $10^7$ [Ω]or greater to $10^{11}$ [Ω] or less.

As the first to fifth embodiments employ insulating material for the first support members, the electric resistance of these first support members is ten times greater than that of the second support members, similar to the sixth to tenth embodiments. However, as already described in the first embodiment, the insulating material limits the height of the first support members for the convenience of prevention of electrical charge up. On the other hand, the sixth to tenth embodiments give conductivity to the first support members, which mitigates the limitation, The freedom of the height of the first support members can improve manufacturing precision. For example, in comparison of manufacturing the support member having a height of 90 $\mu$m (designed value) within difference range of 10 $\mu$m with manufacturing the support member having a height of 900 $\mu$m (designed value) within difference range of 100 $\mu$m, it is clear that the latter can be easily attained. As the manufacturing precision is improved, the voltage Vc applied to the potential-defining electrode can be set to a value close to the value Q calculated by the equation (1) in the first embodiment.

[Sixth Embodiment]

In the display apparatus according to the sixth embodiment, many parts are corresponding to those in the display apparatus of the first embodiment. To avoid complexity of explanation, the explanation of the corresponding parts will be omitted. For example, the preferable shape of the second support members, the structure and manufacturing method of the potential-defining electrode, the structure, characteristic and manufacturing method of the electron-emitting devices, the construction and driving method of the multi electron-beam source having the matrix-wired electron-emitting devices, the construction of the display apparatus will be omitted.

Next, the basic structure of the display apparatus according to the sixth embodiment will be described with reference to FIG. 1.

In this embodiment, the first support members 104 comprise high-resistance conductive material instead of insulating material, and have a thickness greater than that of the first embodiment. The height h at which the potential-defining electrode 105 is provided and voltage Vc outputted from the power source 114 are different from those of the first embodiment.

More specifically, the first support members 104 are formed of low-melting point glass; they have a thickness of 900 $\mu$m, and electric resistance is about $10^{10}$ [Ω]. Note that the second support members 113 comprise the same structure of that of the first embodiment, and have resistance of about $10^8$ [Ω].

As the thickness of the first support members is increased, the height h at which the potential-defining electrode 105 is positioned is increased. The height h is approximately the same as the thickness of the first support members 104.

If an equation h=0.9 [mm] is substituted into the equation (1),

Q=1570 [V]

Va=6000 [V]

Vf=14 [V]

Tc=0.3 [mm]

H=4 [mm]

In the sixth embodiment, the rate of difference of the height h due to manufacturing variation can be reduced, in comparison with the first embodiment. Accordingly, Vc=0.89×Q=1400 [V] is set.

Note that in the first embodiment, as h=0.09 [mm] holds, Q=360 [V] is obtained based on the equation (1). In this case, in consideration of the comparatively large [rate] of the difference of the height h, Vc=0.83×Q=300 [V] is set.

In comparison with the case where the setting is 0.83×Q, the setting 0.89×Q improves efficiency of use of electron beams. That is, in comparison with the first embodiment, the display apparatus of the sixth embodiment is capable of display with higher luminance.

Further, the display apparatus of this embodiment can also prevent problems such as degradation of image quality due to electrical charge on the support members, spark discharge, erroneous operation and damage of the modulation circuit, and unstable operation and degradation of characteristic of the electron-emitting devices.

Note that the-first support members 113 may comprise a different material from that described above, so far as it has resistance is greater than that of the second support members by ten times or more. For example, an insulating substrate having a conductive film on its surface can be employed.

[Seventh Embodiment]

A seventh embodiment of the present invention has a structure where many parts are corresponding to those in the second embodiment, therefore, this embodiment will be described using FIG. 3. The seventh embodiment differs from the second embodiment in that the first support members 104 has conductivity. The first support members 104 has a thickness of 900 [$\mu$m] and resistance of $10^{10}$ [Ω].

Also, the display apparatus of the seventh embodiment can prevent problems such as degradation of image quality due to electrical charge on the support members, spark discharge, erroneous operation and damage of the modulation circuit, and unstable operation and degradation of characteristic of the electron-emitting devices.

[Eighth Embodiment]

An eighth embodiment of the present invention has a structure where many parts are corresponding to those in the third embodiment, therefore, this embodiment will be described using FIGS. 4A to 4C. The eighth embodiment differs from the third embodiment in that the first support members 405 have conductivity. The first support members 405 have a thickness of 800 [$\mu$m] and resistance of $10^9$ [$\Omega$].

Also, the display apparatus of the eighth embodiment can prevent problems such as degradation of image quality due to electrical charge on the support members, spark discharge, erroneous operation and damage of the modulation circuit, and unstable operation and degradation of characteristic of the electron-emitting devices.

[Ninth Embodiment]

In the sixth embodiment, as the electron-emitting devices 102, the SCE type electron-emitting devices are used; in an ninth embodiment, the FE type electron-emitting devices are used. The FE type electron-emitting devices in this embodiment are as shown in FIG. 12. As the electron-emitting devices are the same as those used in the fourth embodiment, the explanation of these devices will be omitted.

Also, the display apparatus of the ninth embodiment can prevent problems such as degradation of image quality due to electrical charge on the support members, spark discharge, erroneous operation and damage of the modulation circuit, and unstable operation and degradation of characteristic of the electron-emitting devices.

[Tenth Embodiment]

A tenth embodiment of the present invention has a structure where many parts are corresponding to those in the fifth embodiment, therefore, this embodiment will be described using FIG. 20. The tenth embodiment differs from the fifth embodiment in that the first support members 2004 have conductivity. The first support members 2004 has a thickness of 900 [$\mu$m] and resistance of $10^{10}$ [$\Omega$].

As the space 2014 can be greater than that in the fifth embodiment, the air-exhaustion conductance in the fifth embodiment is further improved, thus high vacuum condition (low pressure) is attained.

Also, the display apparatus of the tenth embodiment can prevent problems such as degradation of image quality due to electrical charge on the support members, spark discharge, erroneous operation and damage of the modulation circuit, and unstable operation and degradation of characteristic of the electron-emitting devices.

The present invention is not limited to the above embodiments and various changes and modifications can be made within the spirit and scope of the present invention. Therefore, to apprise the public of the scope of the present invention, the following claims are made.

What is claimed is:

1. An image forming apparatus comprising:

a first substrate;

a second substrate disposed opposite to said first substrate, with fluorescent material being provided on said second substrate;

a matrix wiring having a plurality of first wires and a plurality of second wires, with each of said first wires being provided on said first substrate, and each of said second wires intersecting said plurality of first wires;

a plurality of electron-emitting devices arranged in a matrix, each of which emit electrons by applying a signal to said matrix wiring;

a plate-shaped metal electrode provided above said matrix wiring, said metal electrode having a plurality of electron through-holes for passing electrons emitted by the plurality of electron-emitting devices arranged in the matrix; and a support member, having an electric conductivity, provided on said metal electrode, wherein said metal electrode is arranged in parallel to said first substrate and perpendicular to said support member.

2. The apparatus according to claim 1, wherein said support member is provided between said metal electrode and said second substrate.

3. The apparatus according to claim 1, further comprising an acceleration electrode to accelerate electrons emitted by said electron-emitting device disposed on said second substrate.

4. The apparatus according to claim 1, wherein said metal electrode is insulated from said matrix wiring.

5. The apparatus according to claim 1, wherein said support member has a plate-shaped form.

6. The apparatus according to claim 1, wherein either one of said first wires and said second wires is a wire for applying a scanning signal and the other wire is for applying a modulation signal.

7. The apparatus according to claim 1, wherein a single plate-shaped metal electrode is provided above said matrix wiring.

8. The apparatus according to claim 1, further comprising a support member between said metal electrode and said first substrate, wherein said support member has conductivity.

9. The apparatus according to claim 1, further comprising a support member between said metal electrode and said first substrate, wherein the resistance of said support member is greater than or equal to $10^{12}$ and the height of said support member is less than or equal to 500 $\mu$m.

* * * * *

UNITED STATES PATENT AND TRADEMARK OFFICE

CERTIFICATE OF CORRECTION

PATENT NO. : 6,541,905 B1 
DATED : April 1, 2003
INVENTOR(S) : Masahiro Fushimi et al.

It is certified that error appears in the above-identified patent and that said Letters Patent is hereby corrected as shown below:

Column 7,
Line 42, “inventions” should read -- invention; --.

Column 8,
Line 33, “RI” should read -- R1 --.

Column 15,
Line 67, “Åto” should read -- Å to --.

Column 17,
Line 16, “.(X, Y)” should read -- (X, Y) --.

Column 18,
Line 9, “doyn.” should read -- Doyn. --.
Line 59, “f or” should read -- for --.

Column 22,
Line 53, “it has” should read -- its --.

Signed and Sealed this

Eighteenth Day of November, 2003

JAMES E. ROGAN
*Director of the United States Patent and Trademark Office*